US010023372B2

(12) United States Patent
Kastanek et al.

(10) Patent No.: US 10,023,372 B2
(45) Date of Patent: Jul. 17, 2018

(54) CARTON WITH HANDLE AND DISPENSER

(71) Applicant: Graphic Packaging International, Inc., Atlanta, GA (US)

(72) Inventors: Raymond S. Kastanek, Mead, CO (US); Mark Baldino, Marietta, GA (US); Robert L. Sutherland, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/166,841

(22) Filed: May 27, 2016

(65) Prior Publication Data

US 2016/0272393 A1 Sep. 22, 2016

Related U.S. Application Data

(60) Division of application No. 13/794,964, filed on Mar. 12, 2013, now Pat. No. 9,376,230, and a (Continued)

(51) Int. Cl.
*B65D 71/30* (2006.01)
*B65D 5/02* (2006.01)
(Continued)

(52) U.S. Cl.
CPC ..... *B65D 71/30* (2013.01); *B65D 5/0227* (2013.01); *B65D 5/4208* (2013.01); *B65D 5/542* (2013.01);
(Continued)

(58) Field of Classification Search
CPC ..... B65D 71/30; B65D 5/4208; B65D 5/542; B65D 71/22; B65D 71/34; B65D 71/36;
(Continued)

(56) References Cited

U.S. PATENT DOCUMENTS 1,253,193 A 1/1918 Hill
2,594,376 A 4/1952 Arneson
(Continued)

FOREIGN PATENT DOCUMENTS

CA 2160145 9/1995
DE 8514718.4 6/1985
(Continued)

OTHER PUBLICATIONS

International Search Report and Written Opinion for PCT/US2012/026050 dated Sep. 21, 2012.
(Continued)

*Primary Examiner* — Christopher Demeree
(74) *Attorney, Agent, or Firm* — Womble Bond Dickinson (US) LLP

(57) ABSTRACT

A carton for holding a plurality of containers. The carton comprises a plurality of panels extending at least partially around an interior of the carton and a dispenser comprising a dispenser panel. The dispenser panel is at least partially defined by a tear line extending in at least one panel of the plurality of panels. The dispenser panel can be at least partially removable from the carton to create a dispenser opening. The carton also can comprise a handle for grasping and carrying the carton. The handle comprises a handle feature extending in at least the dispenser panel, and at least a portion of the handle can be removable from the carton with the dispenser panel.

56 Claims, 34 Drawing Sheets

Related U.S. Application Data continuation-in-part of application No. 13/402,080, filed on Feb. 22, 2012, now Pat. No. 8,978,963.

(60) Provisional application No. 61/685,394, filed on Mar. 16, 2012, provisional application No. 61/463,847, filed on Feb. 23, 2011.

(51) Int. Cl.

| | |
|---|---|
| ***B65D 71/36*** | (2006.01) |
| ***B65D 5/54*** | (2006.01) |
| ***B65D 71/22*** | (2006.01) |
| ***B65D 71/34*** | (2006.01) |
| ***B65D 5/42*** | (2006.01) |

(52) U.S. Cl.

CPC ..... *B65D 71/22* (2013.01); *B65D 71/34* (2013.01); *B65D 71/36* (2013.01); *B65D 2571/0016* (2013.01); *B65D 2571/0045* (2013.01); *B65D 2571/0066* (2013.01); *B65D 2571/00141* (2013.01); *B65D 2571/00154* (2013.01); *B65D 2571/00172* (2013.01); *B65D 2571/00259* (2013.01); *B65D 2571/00277* (2013.01); *B65D 2571/00444* (2013.01); *B65D 2571/00469* (2013.01); *B65D 2571/00524* (2013.01); *B65D 2571/00549* (2013.01); *B65D 2571/00574* (2013.01); *B65D 2571/00728* (2013.01)

(58) Field of Classification Search

CPC ..... B65D 2571/00438; B65D 2571/00444; B65D 2571/0045; B65D 5/4608; B65D 71/32

USPC ..... 229/117.13, 242, 243, 925, 240, 241; 206/426; 493/88, 909; 53/458

See application file for complete search history.

(56) References Cited

U.S. PATENT DOCUMENTS

| | | | | |
|---|---|---|---|---|
| 2,810,506 | A | 10/1957 | Kessler | |
| 2,868,433 | A | 1/1959 | Anderson, Jr. | |
| 2,955,739 | A | 10/1960 | Collura | |
| 3,112,856 | A | 12/1963 | MacIntosh et al. | |
| 3,127,720 | A | 4/1964 | Gentry et al. | |
| 3,309,005 | A | 3/1967 | Pilger | |
| 3,355,089 | A * | 11/1967 | Champlin | B65D 5/542 229/122.2 |
| 3,886,901 | A | 6/1975 | Zeitter | |
| 4,036,423 | A | 7/1977 | Gordon | |
| 4,111,306 | A | 9/1978 | Roccaforte | |
| 4,216,861 | A | 8/1980 | Oliff | |
| 4,318,474 | A | 3/1982 | Hasegawa | |
| 4,328,923 | A | 5/1982 | Graser | |
| 4,364,509 | A | 12/1982 | Holley et al. | |
| 4,375,258 | A | 3/1983 | Crayne et al. | |
| 4,378,905 | A | 4/1983 | Roccaforte | |
| 4,424,901 | A | 1/1984 | Lanier | |
| 4,449,633 | A * | 5/1984 | Johnson | A47J 36/022 229/100 |
| 4,498,619 | A | 2/1985 | Roccaforte | |
| 4,546,914 | A | 10/1985 | Roccaforte | |
| 4,582,199 | A | 4/1986 | Schuster | |
| 4,588,084 | A | 5/1986 | Holley, Jr. | |
| 4,747,487 | A | 5/1988 | Wood | |
| 4,919,785 | A * | 4/1990 | Willey | B65D 5/5455 229/188 |
| 5,020,337 | A | 6/1991 | Krieg | |
| 5,094,359 | A | 3/1992 | DeMars et al. | |
| 5,197,598 | A | 3/1993 | Stout et al. | |
| 5,246,112 | A | 9/1993 | Stout et al. | |
| 5,284,294 | A | 2/1994 | Floyd | |
| 5,292,058 | A | 3/1994 | Zoss et al. | |
| 5,297,725 | A | 3/1994 | Sutherland | |
| 5,303,863 | A | 4/1994 | Arasim | |
| 5,307,986 | A | 5/1994 | Schuster | |
| 5,333,734 | A | 8/1994 | Stout et al. | |
| 5,427,241 | A | 6/1995 | Sutherland | |
| 5,495,727 | A | 3/1996 | Strong et al. | |
| 5,551,556 | A | 9/1996 | Sutherland | |
| 5,582,343 | A | 12/1996 | Dalvey | |
| 5,593,027 | A | 1/1997 | Sutherland | |
| 5,595,292 | A | 1/1997 | Bates | |
| 5,639,017 | A | 6/1997 | Fogle | |
| 5,699,957 | A | 12/1997 | Blin et al. | |
| 5,704,470 | A | 1/1998 | Sutherland | |
| 5,738,273 | A | 4/1998 | Auclair | |
| 5,794,778 | A | 8/1998 | Harris | |
| 5,826,782 | A | 10/1998 | Stout | |
| 5,873,515 | A | 2/1999 | Dunn et al. | |
| 5,915,546 | A | 6/1999 | Harrelson | |
| 5,992,733 | A | 11/1999 | Gomes | |
| 6,065,590 | A | 5/2000 | Spivey | |
| 6,105,853 | A | 8/2000 | Lamare | |
| 6,105,854 | A | 8/2000 | Spivey et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,523,739 | B2 | 2/2003 | Heeley et al. | |
| 6,631,803 | B2 | 10/2003 | Rhodes et al. | |
| 6,758,337 | B2 | 7/2004 | Chargueraud et al. | |
| 6,926,193 | B2 | 8/2005 | Smalley | |
| 7,427,010 | B2 | 9/2008 | Sutherland | |
| 7,699,215 | B2 * | 4/2010 | Spivey, Sr. | B65D 71/36 206/427 |
| 7,748,603 | B2 | 7/2010 | Fogle et al. | |
| 7,806,314 | B2 | 10/2010 | Sutherland | |
| 8,191,761 | B2 | 6/2012 | Brand | |
| 8,978,963 | B2 | 3/2015 | Kastanek et al. | |
| 9,376,230 | B2 | 6/2016 | Kastanek et al. | |
| 2003/0213263 | A1 | 11/2003 | Woog | |
| 2004/0226988 | A1 * | 11/2004 | Fogle | B65D 71/34 229/103.2 |
| 2004/0238611 | A1 | 12/2004 | Sutherland | |
| 2006/0169755 | A1 | 8/2006 | Spivey, Sr. | |
| 2006/0273143 | A1 | 12/2006 | Finch | |
| 2007/0051781 | A1 | 3/2007 | Holley, Jr. | |
| 2007/0090175 | A1 | 4/2007 | Schemmel | |
| 2007/0164091 | A1 | 7/2007 | Fogle et al. | |
| 2007/0181658 | A1 | 8/2007 | Sutherland | |
| 2007/0284424 | A1 | 12/2007 | Holley | |
| 2008/0073420 | A1 | 3/2008 | Walling et al. | |
| 2010/0044420 | A1 | 2/2010 | Brand | |

FOREIGN PATENT DOCUMENTS

| | | |
|---|---|---|
| DE | 202004018 649 | 4/2005 |
| JP | 2007-055630 A | 3/2007 |
| JP | 2008-013200 A | 1/2008 |
| WO | WO 2005/080218 | 9/2005 |
| WO | WO 2007/089282 | 8/2007 |

OTHER PUBLICATIONS

International Search Report and Written Opinion for PCT/US2013/030321 dated Jun. 12, 2013.

Supplementary European Search Report for EP 12 74 9996 dated Aug. 8, 2014.

Supplementary European Search Report for EP 13 76 1600 dated Jan. 13, 2016.

Office Action for U.S. Appl. No. 13/402,080 dated Mar. 13, 2014.

Amendment A and Response to Office Action for U.S. Appl. No. 13/402,080 dated Jun. 13, 2014.

Office Action for U.S. Appl. No. 13/402,080 dated Aug. 4, 2014.

Amendment B and Response to Final Office Action for U.S. Appl. No. 13/402,080 dated Nov. 4, 2014.

Notice of Allowance and Fee(s) Due for U.S. Appl. No. 13/402,080 dated Nov. 13, 2014.

(56) References Cited

OTHER PUBLICATIONS

Part B—Fee(s) Transmittal for U.S. Appl. No. 13/402,080 dated Feb. 11, 2015.
Issue Notification for U.S. Appl. No. 13/402,080 dated Feb. 25, 2014.
Preliminary for U.S. Appl. No. 13/794,964 dated Jul. 9, 2013.
Office Action for U.S. Appl. No. 13/794,964 dated Nov. 10, 2014.
Response to Election of Species for U.S. Appl. No. 13/794,964 dated Dec. 10, 2014.
Office Action for U.S. Appl. No. 13/794,964 dated Dec. 26, 2014.
Amendment A and Response to Office Action for U.S. Appl. No. 13/794,964 dated Mar. 25, 2015.
Office Action for U.S. Appl. No. 13/794,964 dated May 26, 2015.
Amendment B and Response to Office Action for U.S. Appl. No. 13/794,964 dated Aug. 25, 2015.
Office Action for U.S. Appl. No. 13/794,964 dated Nov. 24, 2015.
Response to Final Office Action for U.S. Appl. No. 13/794,964 dated Jan. 25, 2016.
Office Action for U.S. Appl. No. 13/794,964 dated Feb. 5, 2016.
Amendment C and Response to Final Office Action for U.S. Appl. No. 13/794,964 dated Feb. 17, 2016.
Notice of Allowance and Fee(s) Due for U.S. Appl. No. 13/794,964 dated Feb. 29, 2016.
Issue Fee Transmittal Form for U.S. Appl. No. 13/794,964 dated May 27, 2016.
Issue Notification for U.S. Appl. No. 13/794,964 dated Jun. 8, 2016.

* cited by examiner

CARTON WITH HANDLE AND DISPENSER

CROSS-REFERENCE TO RELATED APPLICATION

This application is a divisional of U.S. patent application Ser. No. 13/794,964, which was filed Mar. 12, 2013, which claims the benefit of U.S. Provisional Application No. 61/685,394, which was filed on Mar. 16, 2012, and which is a Continuation-In-Part of U.S. patent application Ser. No. 13/402,080, which was filed on Feb. 22, 2012, and claims the benefit of U.S. Provisional Application No. 61/463,847, which was filed on Feb. 23, 2011.

INCORPORATION BY REFERENCE

The disclosures of U.S. patent application Ser. No. 13/794,964, which was filed on Mar. 12, 2013, U.S. Provisional Patent Application No. 61/685,394, which was filed on Mar. 16, 2012, U.S. Provisional Patent Application No. 61/463,847, which was filed on Feb. 23, 2011, U.S. patent application Ser. No. 13/402,080, which was filed on Feb. 22, 2012, and U.S. Pat. No. 7,806,314, which was issued on Oct. 5, 2010, are hereby incorporated by reference for all purposes as if presented herein in their entirety.

BACKGROUND OF THE DISCLOSURE

The present disclosure is generally related to a carton for holding containers, and more particularly, to a carton having a handle and a dispenser.

SUMMARY OF THE DISCLOSURE

In one aspect, the disclosure is generally directed to a carton for holding a plurality of containers. The carton comprises a plurality of panels extending at least partially around an interior of the carton and a dispenser comprising a dispenser panel. The dispenser panel is at least partially defined by a tear line extending in at least one panel of the plurality of panels. The dispenser panel can be at least partially removable from the carton to create a dispenser opening. The carton can also comprise a handle for grasping and carrying the carton. The handle comprises a handle feature extending in at least the dispenser panel, and at least a portion of the handle can be removable from the carton with the dispenser panel.

In another aspect, the disclosure is generally directed to a blank for forming a carton. The blank comprises a plurality of panels and dispenser features for forming a dispenser in the carton formed from the blank. The dispenser features comprise a dispenser panel at least partially defined by a tear line extending in at least one panel of the plurality of panels. The dispenser panel can be at least partially removable from the carton formed from the blank. The blank can also comprise handle features for forming a handle in the carton formed from the blank. The handle features extend in at least the dispenser panel, and at least a portion of the handle features can be removable from the carton formed from the blank with the dispenser panel.

In another aspect, the disclosure is generally directed to a method of opening a carton. The method comprises obtaining a carton comprising a plurality of panels extending at least partially around an interior of the carton, a dispenser comprising a dispenser panel, and a handle for grasping and carrying the carton. The dispenser panel can be at least partially defined by a tear line extending in at least one panel of the plurality of panels, and the handle can comprise a handle feature extending in at least the dispenser panel. The method further comprises at least partially removing the dispenser panel to form a dispenser opening in the carton, the dispenser opening providing access to the interior of the carton. The at least partially removing the dispenser panel comprises at least partially removing the handle feature in the dispenser panel.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, metal; glass; aluminum and/or composite materials; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum, plastic, and/or glass beverage bottles) as disposed within the carton embodiments. In this specification, the terms "inner," "outer," "lower," "bottom," "upper," and "top" indicate orientations determined in relation to fully erected and upright cartons.

Figure 1:
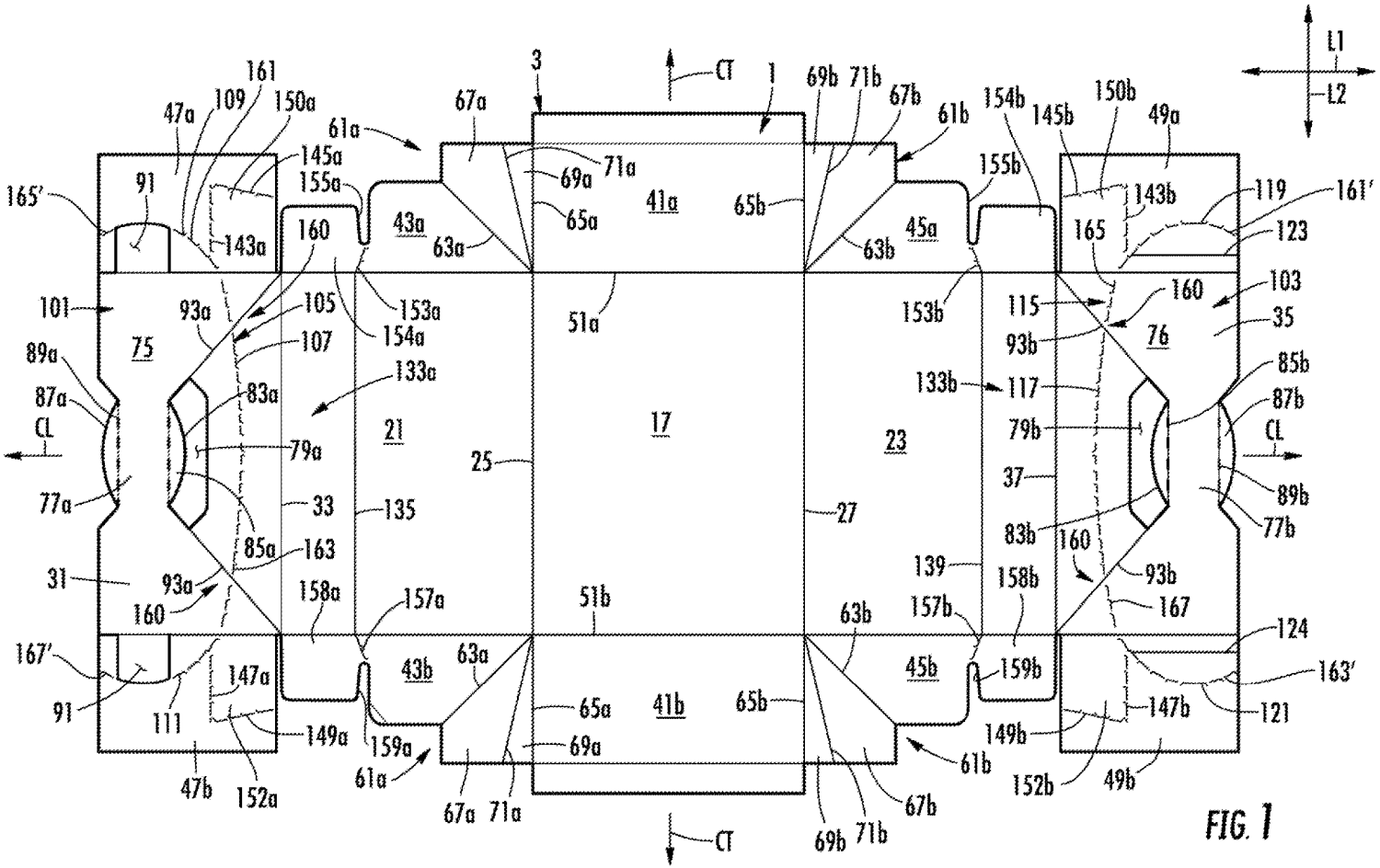
FIG. 1 is a plan view of a blank used to form a carton according to a first embodiment of the disclosure.
Figure 5:
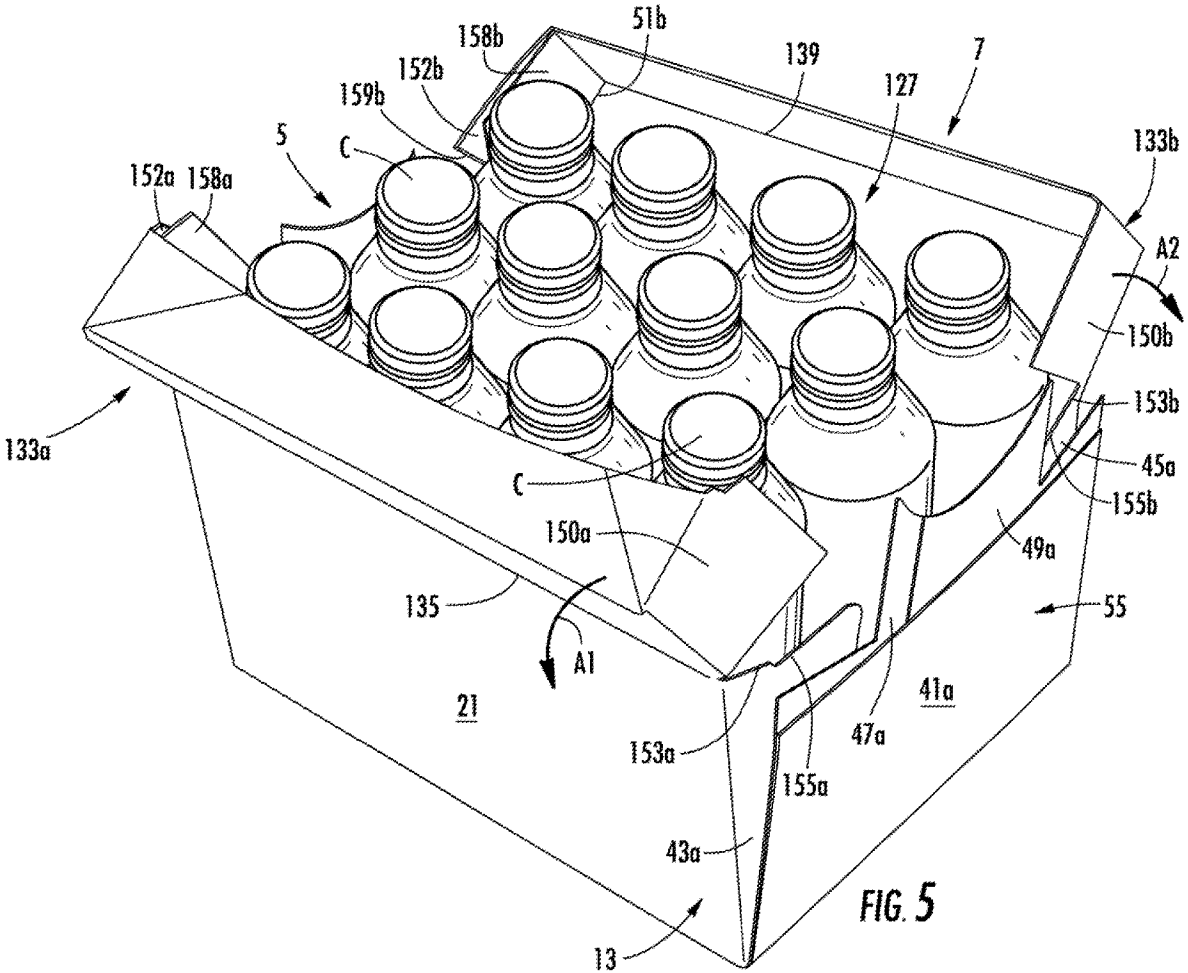
FIG. 5 is a perspective view of the opened carton of FIG. 4 with a first opening section and second opening section being pivoted outwardly.
Figure 6:
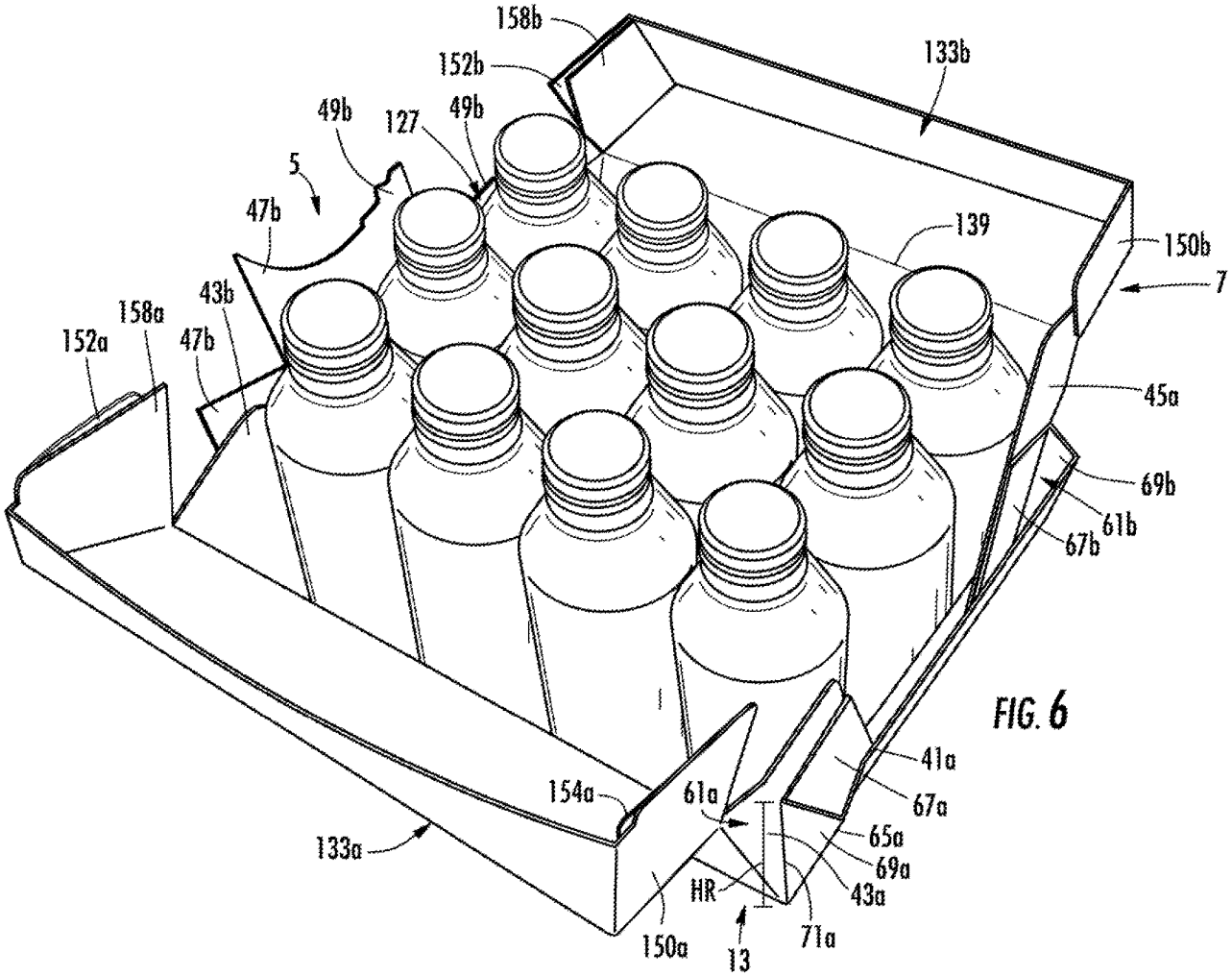
FIG. 6 is perspective view of the carton of FIG. 5 with a further expanded dispenser opening.

FIG. 1 is a plan view of the exterior side 1 of a blank, generally indicated at 3, used to form a carton 5 (FIG. 2) according to the exemplary embodiment of the disclosure. The carton 5 can be used to house a plurality of articles such as containers C (FIGS. 3-6). The carton 5 has a dispenser, generally indicated at 7 (FIG. 2), formed in the carton for allowing access to the containers from the top of the carton, and a handle, generally indicated at 11, formed in the top of the carton for grasping and carrying the carton. As shown in FIGS. 5 and 6, an expandable bottom receptacle 13 is formed in the bottom of the carton 5 for accommodating, for example, liquids, ice, or other coolants in the carton bottom. In one exemplary embodiment, ice can be added to the opened carton 5 to cool containers C, and beverages held therein. As the ice melts, all or a part of the resultant runoff water is held within the expandable bottom receptacle 13.

In the illustrated embodiment, the carton 5 is sized to house twelve containers C in a single layer in a 3×4 arrangement, but it is understood that the carton may be sized and shaped to hold containers of a different or same quantity in more than one layer and/or in different row/column (e.g., arrangements 1×6, 3×6, 2×6, 2×6×2, 3×4×2, 2×9, etc.).

The blank 3 has a longitudinal axis L1 and a lateral axis L2. As shown in FIG. 1, the blank 3 may have at least partial symmetry about a longitudinal center line $C_L$ and about a lateral center line $C_T$. Therefore, certain elements in the drawing figures have similar or identical reference numerals in order to reflect the whole or partial longitudinal and transverse symmetries and similar or like elements may be indicated by an "a" or "b" suffix designation for a corresponding reference number. The blank 3 comprises a bottom panel 17 foldably connected to first and second side panels 21, 23 at respective transverse fold lines 25, 27, a first top panel 31 foldably connected to the first side panel 21 at a transverse fold line 33, and a second top panel 35 foldably connected to the second side panel 23 at a transverse fold line 37. The first and second top panels 31, 35 at least partially overlap in the erected carton 5.

The bottom panel 17 is foldably connected to a first bottom end flap 41*a* and a second bottom end flap 41*b*. The first side panel 21 is foldably connected to a first side end flap 43*a* and a second side end flap 43*b*. The second side panel 23 is foldably connected to a first side end flap 45*a* and a second side end flap 45*b*. The first top panel 31 is foldably connected to a first top end flap 47*a* and a second top end flap 47*b*. The second top panel 35 is foldably connected to a first top end flap 49*a* and a second top end flap 49*b*.

The end flaps 41*a*, 43*a*, 45*a*, 47*a*, 49*a* extend along a first marginal area of the blank 3, and are foldably connected at a first longitudinal fold line 51*a* that extends along the length of the blank. The end flaps 41*b*, 43*b*, 45*b*, 47*b*, 49*b* extend along a second marginal area of the blank 3, and are foldably connected at a second longitudinal fold line 51*b* that also extends along the length of the blank. The longitudinal fold lines 51*a*, 51*b* may be, for example, substantially straight, or offset at one or more locations to account for blank thickness or for other factors. When the carton 5 is erected, the end flaps 41*a*, 43*a*, 45*a*, 47*a*, 49*a* close a first end 55 of the carton, and the end flaps 41*b*, 43*b*, 45*b*, 47*b*, 49*b* close a second end 57 of the carton. In accordance with an alternative embodiment of the present disclosure, different flap arrangements can be used for closing the ends 55, 57 of the carton 5.

Four gussets 61*a*, 61*b* are formed in the blank 3, one at each corner of the bottom panel 17. Two of the gussets 61*a* are respectively foldably connected to the respective side end flaps 43*a*, 43*b* of the first side panel 21 at oblique fold lines 63*a*, and to the respective bottom end flaps 41*a*, 41*b* at lateral fold lines 65*a*. Each gusset 61*a* comprises a first gusset panel 67*a* foldably connected to a second gusset panel 69*a* at an oblique fold line 71*a*. The other two gussets 61*b* are respectively foldably connected to the side flaps 45*a*, 45*b* of the second side panel 23 and the bottom end flaps 41*a*, 41*b* in a similar arrangement and manner as the gussets 61*a*, and the gussets 61*b* have similar features as the gussets 61*a* (e.g., fold lines 63*b*, 65*b*, 71*b*, first gusset panels 67*b*, and second gusset panels 69*b*).

The features that comprise the handle 11 include a first handle panel 75 in the first top panel 31 and a second handle panel 76 in the second top panel 35. The features of the first handle panel 75 are indicated by reference numbers having the "a" suffix, and the features of the second handle panel 76 are indicated by reference numbers having a "b" suffix. The handle panels 75, 76 include a narrow gripping portion 77*a*, 77*b* centrally located in a respective top panel 31, 35. Each of the top panels 31, 35 includes an aperture 79*a*, 79*b* adjacent the respective gripping portions 77*a*, 77*b* and at least partially defining a respective first cushion portion 83*a*, 83*b* foldably connected to the respective gripping portions 77*a*, 77*b* at a respective lateral fold line 85*a*, 85*b*. Each of the handle panels 75, 76 has a respective second cushion portion 87*a*, 87*b* foldably connected to the respective gripping portions 77*a*, 77*b* at a respective lateral fold line 89*a*, 89*b*. The first handle panel 75 is at least partially defined by end handle apertures 91 that are formed in the end flaps 47*a*, 47*b* at the fold lines 51*a*, 51*b*. In one embodiment, the features that form the handle 11 include oblique fold lines 93*a*, 93*b* extending from the respective apertures 79*a*, 79*b* in the first top panel 31 and the second top panel 35. The handle panels 75, 76 could be otherwise shaped, arranged, and/or configured without departing from the disclosure, and the blank 3 could have other features for forming the handle 11 without departing from the disclosure.

In the illustrated embodiment, the features that form the dispenser 7 in the carton include a first dispenser panel 101 in the first top panel 31 and the top end flaps 47*a*, 47*b*, and a second dispenser panel 103 in the second top panel 35 and the top end flaps 49*a*, 49*b*. The first dispenser panel 101 and the second dispenser panel 103 are at least partially overlapped in the carton 5. The first dispenser panel 101 is formed by a tear line 105 comprising an arcuate portion 107 in the top panel 31, an arcuate portion 109 in the top end flap 47*a*, and an arcuate portion 111 in the top end flap 47*b*. The arcuate portions 109, 111 can be interrupted by the end handle apertures 91 in the respective top end flaps 47*a*, 47*b*. The second dispenser panel 103 is formed by a similarly shaped tear line 115 having respective arcuate portions 117, 119, 121. In the illustrated embodiment, the tear lines 105, 115 cooperate to form a generally oval-shaped dispenser panel 125 (FIG. 2) from the partially overlapped first and second dispenser panels 101, 103. The dispenser panel 125 extends across the top of the carton and into the ends of the carton. The dispenser panel 125 can be separated from the carton along the tear lines 105, 115 to create a dispenser opening 127 (FIGS. 3 and 4) for accessing the containers C. Opening of the dispenser panel 125 can be facilitated by scores or fold lines 123, 124 in the portions of the second dispenser panel 103 in the respective top end flaps 49*a*, 49*b*. The fold lines 123, 124 can allow the ends of the dispenser panel 125 to be folded inwardly to initiate tearing along the fold lines 105, 115. The first dispenser panel 101, the second dispenser panel 103, and/or the tear lines 105, 115 can be otherwise shaped, arranged, and/or configured without departing from the disclosure.

Figure 1A:
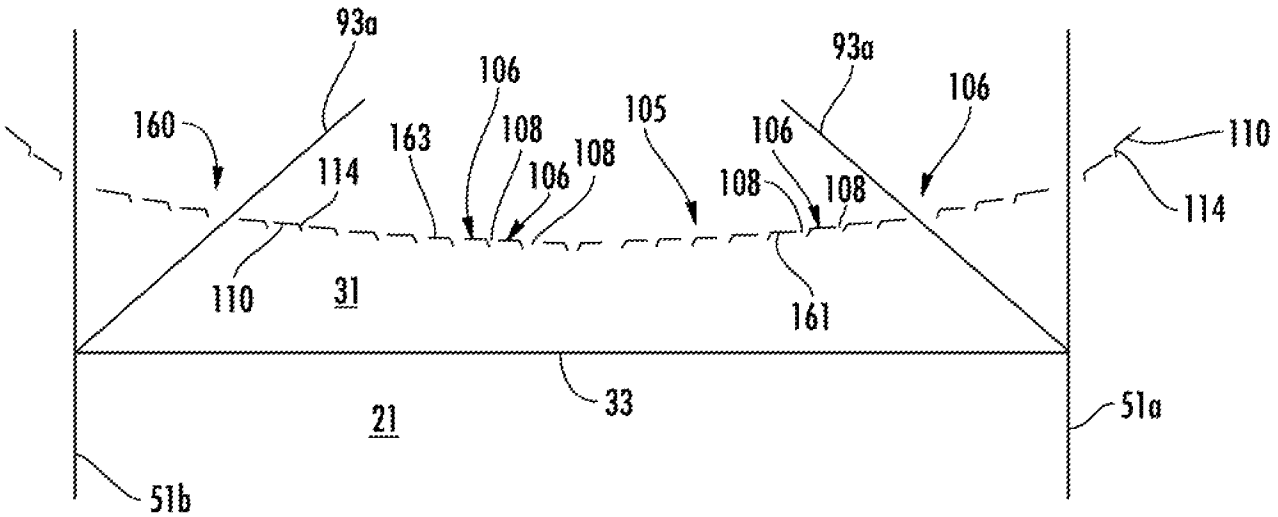
FIG. 1A is a schematic view of a tear line extending in the blank of FIG. 1.

In one embodiment, the blank 3 can include features for reducing unwanted tearing along the tear lines 105, 115 when the handle 11 is in use. For example, as shown in FIGS. 1 and 1A, each of the tear lines 105, 115 comprises a series of slits 106 and nicks 108 that are arranged so that none of the slits 106 interrupts the oblique fold lines 93*a*, 93*b*. Accordingly, the tear lines 105, 115 include gaps 160 proximate the oblique fold lines 93*a*, 93*b* so that when the carton 5 is carried at the handle 11, the force on the handle 11 can be directed along the oblique fold lines 93*a*, 93*b* to the corners of the carton 5 through the gaps 160. Most of the weight of the carton 5 is then supported by the stronger portions of the top panels 31, 35 with little or none of the weight being directed across the slits 106 of the tear lines 105, 115 to help avoid initiation of tearing along the tear lines when the handle 11 is in use. However, in the illustrated embodiment, the gaps 160 are not so large that they would stop tearing of the tear lines 105, 115 when removing the dispenser panel 125. When the tearing of the tear lines 105, 115 is initiated at the ends 55, 57 of the carton, the tear lines can continue to tear across the gaps 160 similarly to the tearing of the nicks 108 between the respective slits 106 of the tear lines. The slits 106 of the tear lines 105, 115 can also be spaced apart from the longitudinal fold lines 51*a*, 51*b* to help avoid weakening the carton 5 at the edges of the top panels 31, 35.

As shown in FIG. 1A, the slits 106 of the tear lines 105, 115 can include a main portion 110 that is generally directed along the contour of the respective tear line 105, 115 and an oblique portion 114 that is oblique with respect to the main portion 110. In general, the slits 106 are configured so that the main portion 110 of each slit 106 extends from a preceding nick 108 in the direction of tearing and the oblique portion 114 of the same slit 106 extends from the main portion 110 to a subsequent nick 108 in the direction of tearing. As shown in FIG. 1, the tear line 105 can include a first directional portion 161 extending from the handle aperture 91 in the top end flap 47*a* to the centerline CL in the top panel 31 and a second directional portion 163 extending from the handle aperture 91 in the top end flap 47*b* to the centerline CL in the top panel 31. Similarly, the tear line 115 can include a first directional portion 165 extending in the top end flap 49*a* to the centerline CL in the top panel 35 and a second directional portion 167 extending in the top end flap 49*b* to the centerline CL in the top panel 35. Each of the directional portions 161, 163, 165, 167 is configured to be torn from the respective end flaps 47*a*, 47*b*, 49*a*, 49*b* to the centerline CL in the respective top panels 31, 35. Accordingly, the dispenser panel 125 can be removed by tearing the tear lines 105, 115 from each end 55, 57 towards the centerline CL. End directional portions 161', 163' of the tear line 115 overlap the respective first and second directional portions 161, 163 of the tear line 105 when the carton 5 is erected. Similarly, end directional portions 165', 167' of the tear line 105 overlap the respective first and second directional portions 165, 167 of the tear line 115 when the carton 5 is erected. Accordingly, the end directional portions 161', 163', 165', 167' are configured to be torn along with and in the direction of the respective directional portions 161, 163, 165, 167. The directional nature of the directional portions of the tear lines helps to encourage tearing from the ends 55, 57 of the carton 5, such as when removing the dispenser panel 125, and helps to inhibit tearing from the center of the top panels 31, 35, such as due to stress on the top panels 31, 35 from supporting the weight of the carton 5 at the handle 11. The tear lines 105, 115 can be otherwise shaped, arranged, and/or configured without departing from the disclosure.

In the illustrated embodiment, the blank 3 includes a first opening section 133*a* foldably connected to the first side panel 21 at a lateral fold line 135 extending across the first side panel, and a second opening section 133*b* foldably connected to the second side panel 23 at a lateral fold line 139 extending across the second side panel. The first opening section 133*a* is at least partially defined by the arcuate portion 107 of the tear line 105 in the first top panel 31, a lateral tear line 143*a* in the top end flap 47*a*, an oblique tear line 145*a* in the top end flap 47*a*, a lateral tear line 147*a* in the top end flap 47*b*, and an oblique tear line 149*a* in the top end flap 47*b*. The lateral tear line 143*a* and the oblique tear line 145*a* can at least partially define an end portion 150*a* of the opening section 133*a* in the top end flap 47*a*, and the lateral fold line 147*a* and the oblique tear line 149*a* can at least partially define an end portion 152*a* of the opening section 133*a* in the top end flap 47*b*. Also, the first opening section 133*a* is defined by an oblique tear line 153*a* extending from the longitudinal fold line 51*a* to a notch 155*a* in the side end flap 43*a* and an oblique tear line 157*a* extending from the longitudinal fold line 51*b* to a notch 159*a* in the side end flap 43*b*. The tear lines 153*a*, 157*a* can extend from respective ends of the lateral fold line 135 in one embodiment. The tear lines 153*a*, 157*a* and the notches 155*a*, 159*a* can define respective upper portions 154*a*, 158*a* of the respective side end flaps 43*a*, 43*b*. The upper portions 154*a*, 158*a* of the side end flaps 43*a*, 43*b* can be glued to the respective end portions 150*a*, 152*a* of the opening section 133*a* to form the ends of the opening section 133*a* in the carton 5. Additionally, the oblique tear lines 145*a*, 149*a* can at least partially overlap the respective tear lines 153*a*, 157*a* when the ends of the opening section 133*a* are formed. The first opening section 133*a* could be otherwise shaped, arranged, configured, and/or omitted without departing from the disclosure.

In one embodiment, the second opening section 133*b* is similarly shaped as the opening section 133*a* and has similar or identical features designated by a "b" suffix on the reference numbers. The opening section 133*b* is at least partially defined by tear lines 117, 143*b*, 145*b*, 147*b*, 149*b*, 153*b*, 157*b*, notches 155*b*, 159*b*, and the fold line 139. Upper portions 154*b*, 158*b* of the respective side end flaps 45*a*, 45*b* can be glued to respective end portions 150*b*, 152*b* of the opening section 133*b* to form the ends of the opening section 133*b* in the carton 5. The second opening section 133*b* could be otherwise shaped, arranged, configured and/or omitted without departing from the disclosure.

An exemplary method of erecting the carton 5 is discussed below. Glue or other adhesive is applied to the upper or exterior side of the first top panel 31 and all or a portion of the top end flaps 47*a*, 47*b*, 49*a*, 49*b* may also have glue applied thereto. Portions of the side end flaps 43*a*, 43*b* that will overlap one or more of the gusset panels 67*a*, 67*b* may also have glue applied thereto. The first and second top panels 31, 35 are overlapped and secured together with the gripping portions 77*a*, 77*b* of the respective first and second handle panels 75, 76 overlapped to form in the handle 11. The side panels 21, 23 are folded relative to the bottom panel 17 and the overlapped top panels 31, 35 to form a generally open-ended sleeve. Containers C can be loaded into the open-ended sleeve. Alternatively, one end of the sleeve can be closed prior to loading the containers C.

Figure 2:
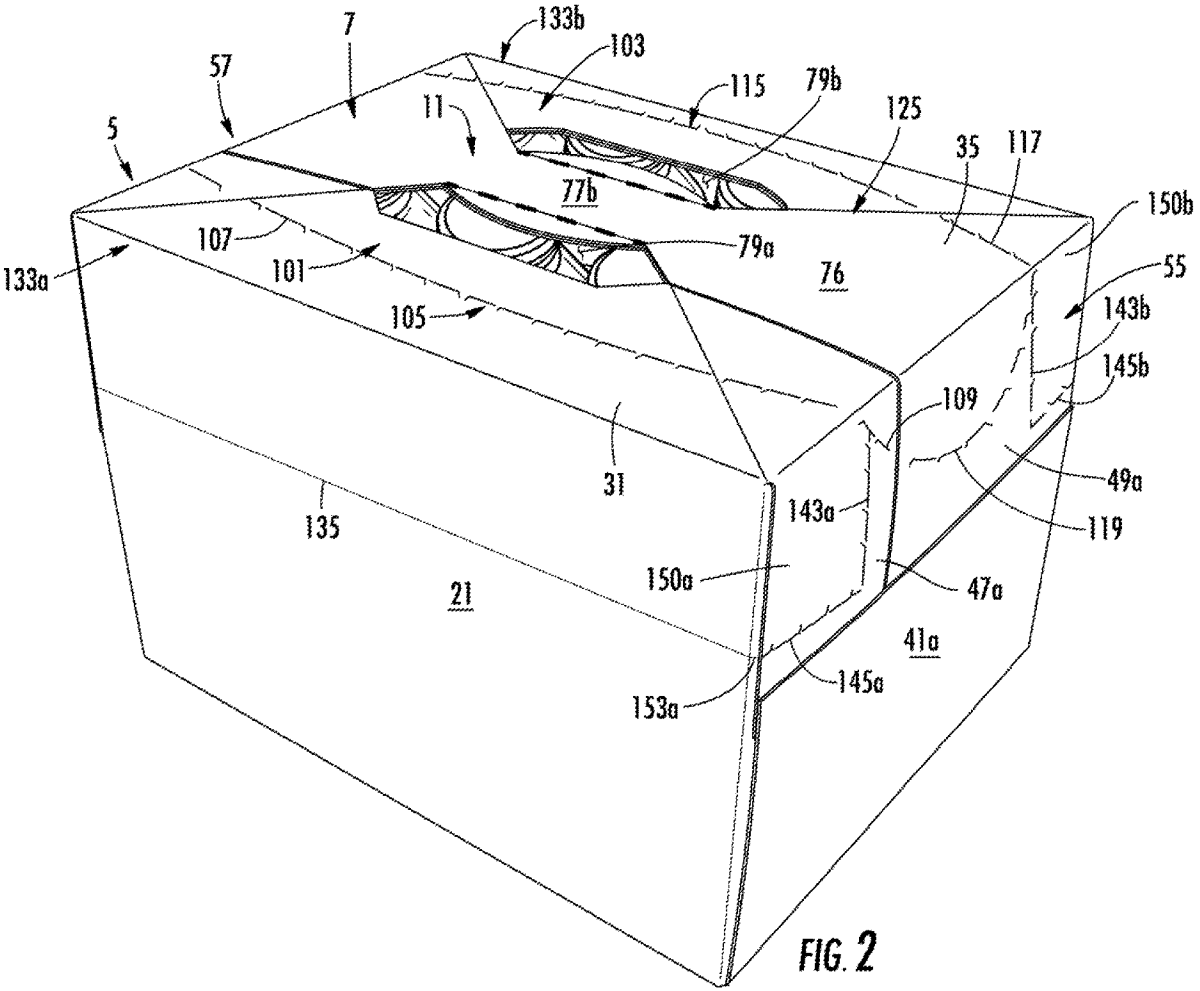
FIG. 2 is a perspective view of the carton assembled from the blank of FIG. 1.

After loading the containers C, the end flaps 41*a*, 43*a*, 45*a*, 47*a*, 49*a* can be overlapped and secured to close the first end 55 of the carton 5 (FIG. 2), and the end flaps 41*b*, 43*b*, 45*b*, 47*b*, 49*b* can be overlapped and secured to close the second end 57 of the carton (FIG. 2). During the closing of the ends 55, 57 the gusset panels 67*a*, 67*b* and the gusset panels 69*a*, 69*b* can be folded to be in face-to-face contact with the respective side end flaps 43*a*, 43*b*, 45*a*, 45*b*, with the gusset panels 67*a*, 67*b* being adhesively secured to the respective side end flaps 43*a*, 43*b*, 45*a*, 45*b*. In this manner the expandable bottom receptacle 13 can be formed. A portion of each of the bottom end flaps 41*a*, 41*b* can be adhered to a portion of the respective top end flaps 47*a*, 49*a* and 47*b*, 49*b*. Additionally, during the closing of the ends 55, 57, the upper portions 154*a*, 158*a*, 154*b*, 158*b* of the respective side end flaps 43*a*, 43*b*, 45*a*, 45*b* can be glued to the respective end portions 150*a*, 152*a*, 150*b*, 152*b* to form the respective ends of the opening sections 133*a*, 133*b*. The carton 5 can be alternatively erected without departing from the disclosure.

In the illustrated embodiment, the handle 11 is a two-ply handle formed by the overlapped first and second handle panels 75, 76, but the carton 5 could have other handle arrangements that are other than two-ply (e.g., single-play, three-ply, etc.) without departing from the disclosure. The carton 5 may be, for example, parallelepipedal or generally parallelepipedal in shape, or may be other shapes without departing from the disclosure.

Figure 3:
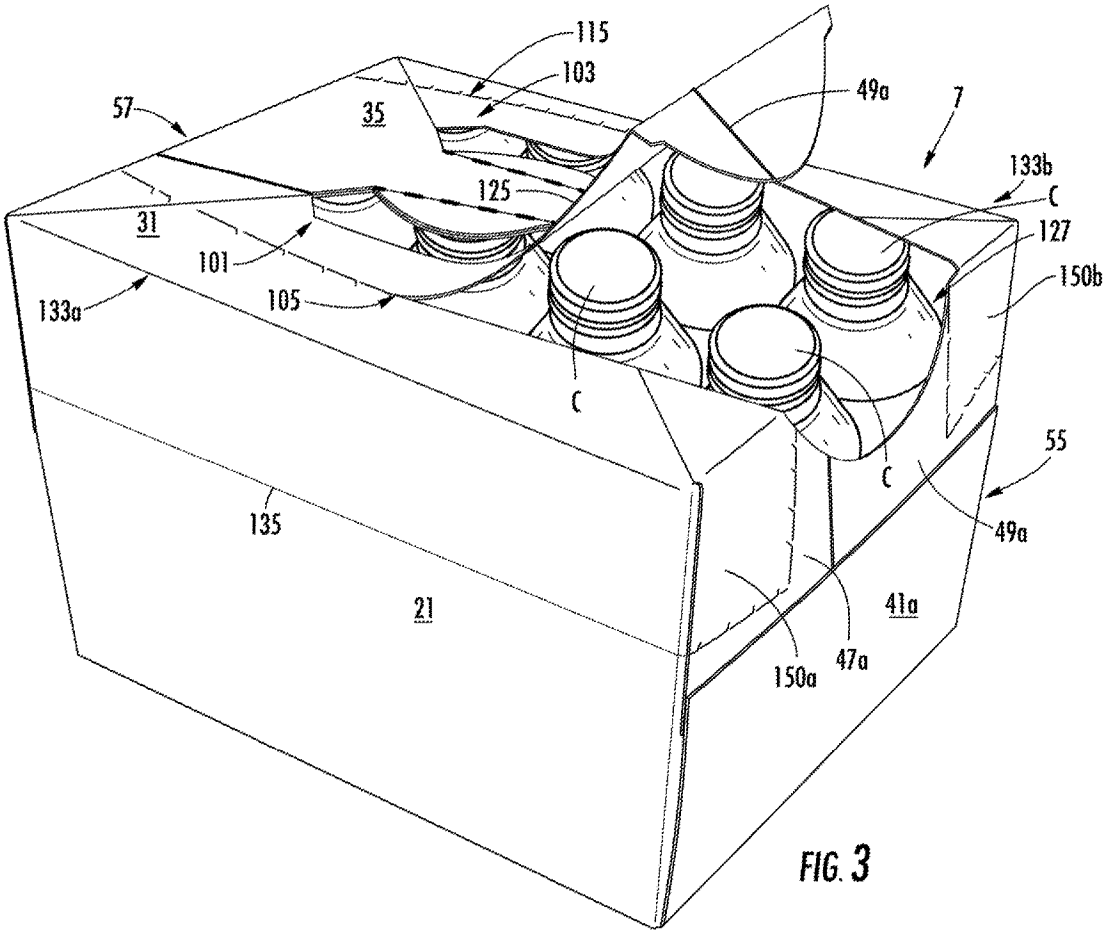
FIG. 3 is a perspective view of the carton of FIG. 2 with a dispenser panel partially removed.
Figure 4:
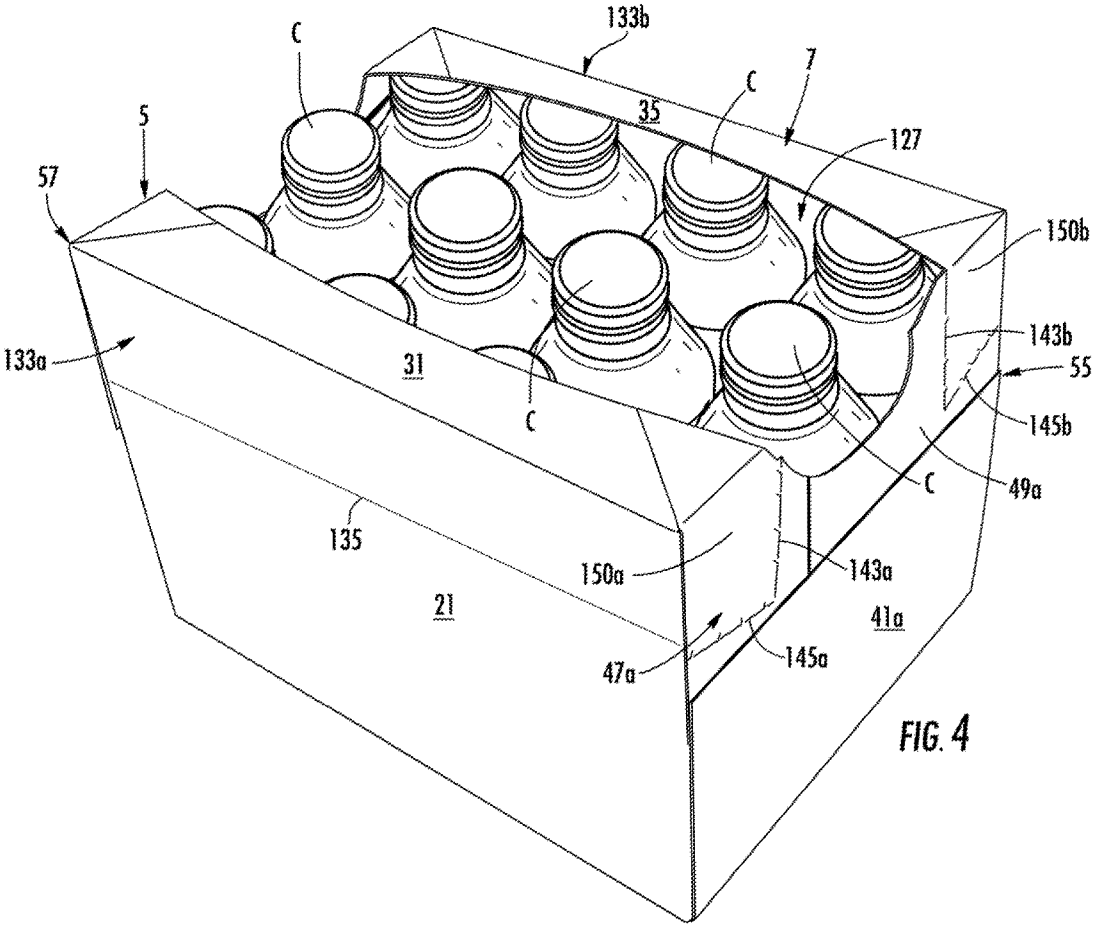
FIG. 4 is a perspective view of the carton with the dispenser panel removed to create a dispenser opening.

As shown in FIGS. 3 and 4, the dispenser 7 is activated to an initially opened condition (FIG. 4) by breaching the carton along the tear lines 105, 115 to separate the dispenser panel 125 from the carton and create the dispenser opening 127 for accessing the containers C. As shown in FIGS. 5 and 6, the dispenser opening 127 can be expanded by separating the first opening section 133*a* and second opening section 133*b* from the ends 55, 57 of the carton 5 and pivoting the opening sections about respective fold lines 135, 139. The first opening section 133*a* is separated from the ends 55, 57 by tearing along tear lines 143*a*, 145*a*, 147*a*, 149*a*, 153*a*, 157*a* and the second opening section is separated from the ends 55, 57 by tearing along tear lines 143*b*, 145*b*, 147*b*, 149*b*, 153*b*, 157*b*. As shown in FIG. 5 each opening section 133*a*, 133*b* can be pivoted outwardly in the direction of arrows A1, A2 to expand the dispenser opening 127. The expanded dispenser opening 127 (FIG. 6) of the carton 5 allows the carton to accommodate ice or other coolant.

According to the above embodiment, ice, cold water, additional containers, or other items, for example, can be placed in the carton 5 through the expanded dispenser opening 127. The gussets 61*a*, 61*b*, the bottom end panels 41*a*, 41*b*, the side end flaps 43*a*, 43*b*, 45*a*, 45*b*, and lower portions of the side panels 21, 23 at least partially close the bottom portion of the carton 5 and create the at least partially closed expandable bottom receptacle 13 in the bottom of the carton. Prior to separating the opening sections 133*a*, 133*b* from the ends 55, 57 of the carton 5 (FIGS. 2-4), the top end flaps 47*a*, 47*b*, 49*a*, 49*b* are retained against the respective side end flaps 43*a*, 43*b*, 45*a*, 45*b* since the upper portions 154*a*, 158*a*, 154*b*, 158*b* are glued to the end portions 150*a*, 152*a*, 150*b*, 152*b*. Since the bottom end flaps 41*a*, 41*b* are glued to the top end flaps 47*a*, 47*b*, 49*a*, 49*b*, the bottom end flaps 41*a*, 41*b* are retained against the gussets 61*a*, 61*b* and the side end flaps 43*a*, 43*b*, 45*a*, 45*b*. Once the opening sections 133*a*, 133*b* are separated from the ends 55, 57 of the carton 5 (FIGS. 5 and 6), the remainders of the top end flaps 47*a*, 47*b*, 49*a*, 49*b* and the bottom end flaps 41*a*, 41*b* are free to pivot away from the side end flaps 43*a*, 43*b*, 45*a*, 45*b*. Accordingly, the gusset panels 69*a*, 69*b* can fold with respect to the side end flaps 43*a*, 43*b*, 45*a*, 45*b* and the bottom end flaps 41*a*, 41*b*. Accordingly, the side panels 21, 23 can pivot somewhat about the respective transverse fold lines 25, 27, and the bottom end flaps 41*a*, 41*b* can pivot somewhat about the respective longitudinal fold lines 51*a*, 51*b*. Accordingly, the gussets 61*a*, 61*b* allow further opening of the dispenser opening 127. Additionally, the expandable bottom receptacle 13 of the opened carton 5 can be used to retain liquids, such as water formed from melting ice, condensation, other liquids, and articles such as, for example, refuse or fine particulate matter such as powders.

The expandable bottom receptacle 13 may have a height $H_R$ below which the carton 5 is liquid-tight. The height $H_R$ represents a portion of the bottom of the carton 5 below which no glued seals or seams are formed through which water or other liquid might leak. In one embodiment, the height $H_R$ is approximately equal to the length of the fold line 71*a*, 71*b* connecting the gusset panel 67*a*, 67*b* with the gusset panel 69*a*, 69*b*. That is, in accordance with the illustrated embodiment, no adhesive seal or other joinder of material where fluid might escape the carton 5 is located in the carton below the height $H_R$. The expandable bottom receptacle 13 may therefore be formed from a continuous section of folded material of the blank 3. The height $H_R$ of the liquid-tight portion of the receptacle 13 below which there are no glued seams may generally be between approximately 0 inches to approximately 4 inches (approximately 0 mm to approximately 102 mm), and, more preferably, may be approximately 2¾ inches (approximately 70 mm). It is understood that all dimensional information presented herein is intended to be illustrative and is not intended to be used to limit the scope of the disclosure.

In alternative embodiments, a dispenser with at least a portion of a handle can be used with substantially any package, such as the carton 5 of the first embodiment, a wrap-around carrier, or any other style of carton so that a handle is removed from the carton when the dispenser is activated. Alternatively, the handle can be removed similarly to a dispenser panel without forming a dispenser opening. In one example, the handle can be removed to inhibit carrying of the carton after significant weight has been added to the carton or the carton has been potentially weakened (such as by adding ice or water).

Figure 7:
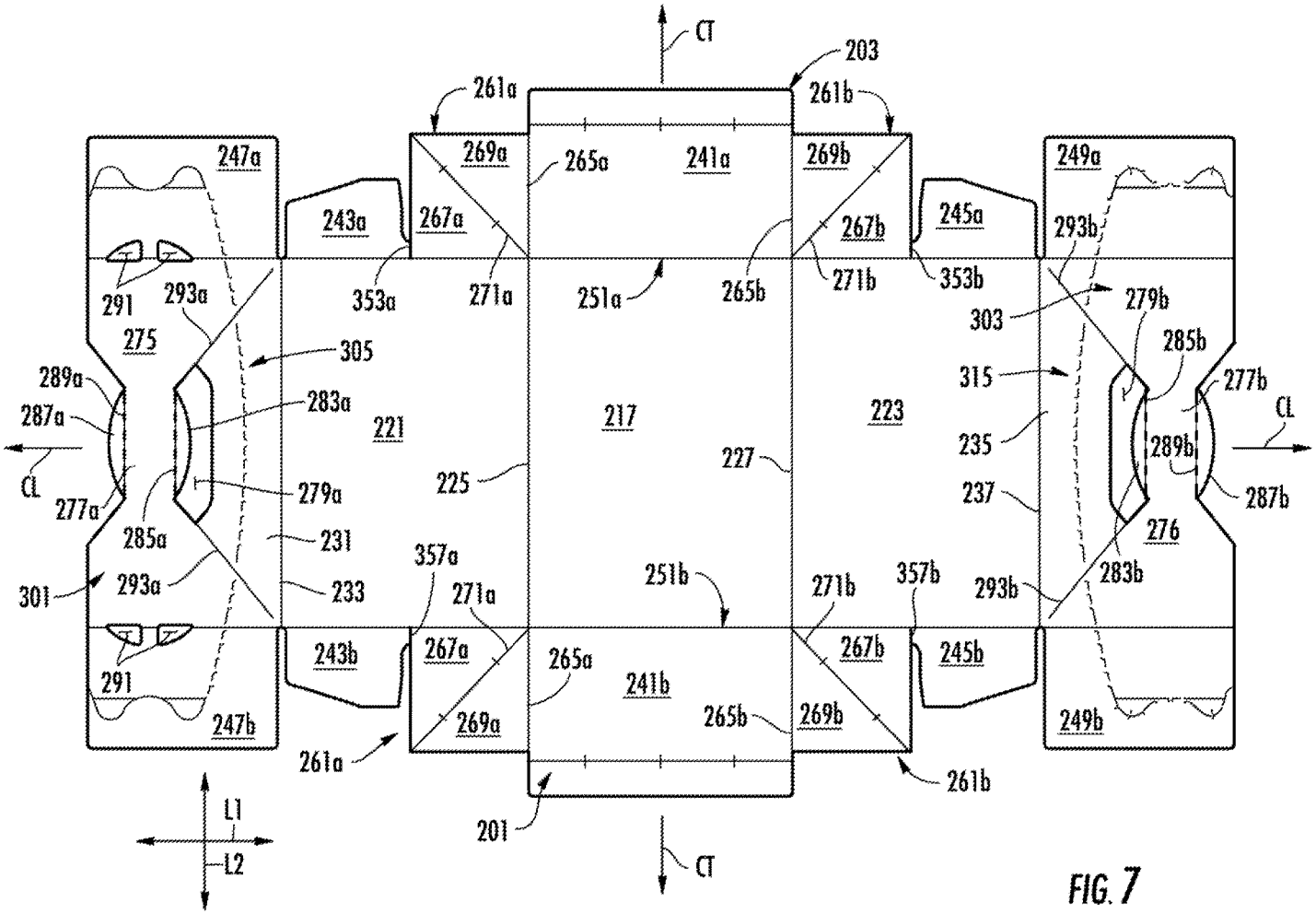
FIG. 7 is a plan view of a blank used to form a carton according to a second embodiment of the disclosure.

FIG. 7 illustrates an exterior side 201 of a blank 203 for forming a carton 205 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. The blank 203 has a longitudinal axis L1 and a lateral axis L2. The carton 205 is illustrated in its erected state in FIGS. 8 and 9.

Referring to FIG. 7, the blank 203 can include a gusset 261*a*, 261*b* at the four corners of the bottom panel 217 for forming a generally liquid-tight bottom receptacle in the carton 205. Each of the gussets 261*a* includes a first gusset panel 267*a* foldably connected to a second gusset panel 269*a* along an oblique fold line 271*a*. A kiss-cut or partial cut can be formed in each of the fold lines 271*a* to aid in assembling the carton 5, such as by helping to make the folding of the gusset panels 267*a*, 269*a* along the fold lines 271*a* easier. The first gusset panels 267*a* are foldably connected to the first side panel 221 along respective longitudinal fold lines 251*a*, 251*b*, and the second gusset panels 269*a* are foldably connected to respective bottom end flaps 241*a*, 241*b* along lateral fold lines 265*a*. The side end flaps 243*a*, 243*b* are separable from the first gusset panels 267*a* along respective cut lines 353*a*, 357*a*. Alternatively, the cut lines 353*a*, 357*a* could be tear lines, fold lines, scores, etc. The gussets 261*b* are respectively foldably connected to the second side panel 223 and the bottom end flaps 241*a*, 241*b* in a similar arrangement and manner as the gussets 261*a*, and the gussets 261*b* have similar features as the gussets 261*a* (e.g., fold lines 265*b*, 271*b*, first gusset panels 267*b*, and second gusset panels 269*b*). When the carton 5 is formed, the gussets 261*a*, 261*b* can be folded against and adhered to the bottom end flaps 241*a*, 241*b*, the side panels 221, 223, or a combination of both to form the bottom receptacle. The gussets 261*a*, 261*b* can be omitted or otherwise shaped, arranged, and/or configured without departing from the disclosure.

Figure 7A:
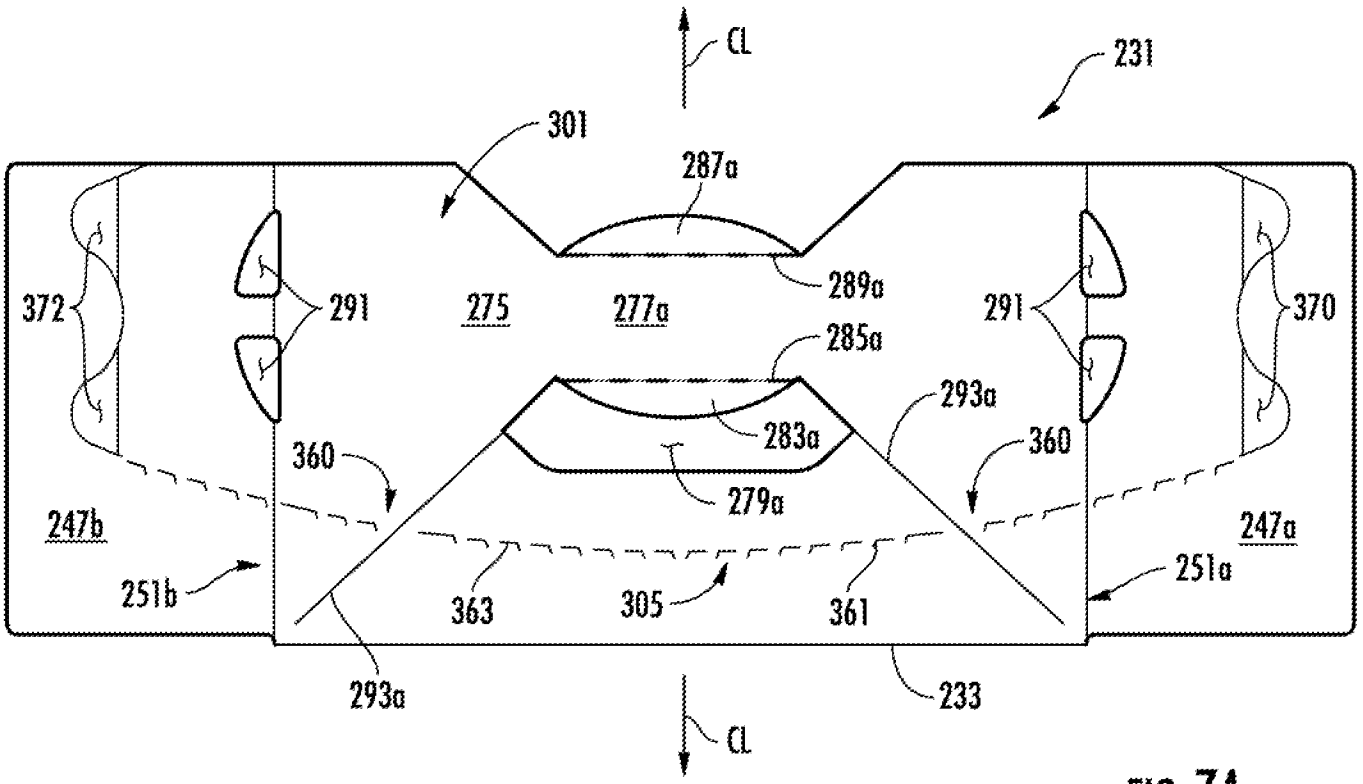
FIGS. 7A and 7B are plan views of the top panels of the blank of FIG. 7.

The dispenser 207 and the handle 211 are similar to the dispenser 7 and the handle 11 of the first embodiment, except the dispenser 207 omits the opening sections and includes an alternative opening section at each end 255, 257 of the carton 205. As shown in FIG. 7A, the first dispenser panel 301 in the first top panel 231 is at least partially defined by a tear line 305 extending from access openings 370 in the first top end flap 247*a* to access openings 372 in the second top end flap 247*b*. The tear line 305 includes a first directional portion 361 extending from the openings 370 to the centerline CL of the first top panel 231 and a second directional portion 363 extending from the openings 372 to the centerline CL of the first top panel 231. The first and second directional portions 361, 363 are configured to be torn from the respective access openings 370, 372 towards the centerline CL of the first top panel 231. The tear line 305 also includes gaps 360 between the slits forming the tear line proximate the oblique fold lines 293*a*. The slits of the fold line 305 can also be spaced apart at the longitudinal fold lines 251*a*, 251*b*. The first dispenser panel 301 can also include two openings 291 interrupting each of the longitudinal fold lines 251*a*, 251*b* to help fold the overlapped end flaps 247*a*, 249*a* and 247*b*, 249*b* over the ends 255, 257 of the carton 205.

Figure 7B:
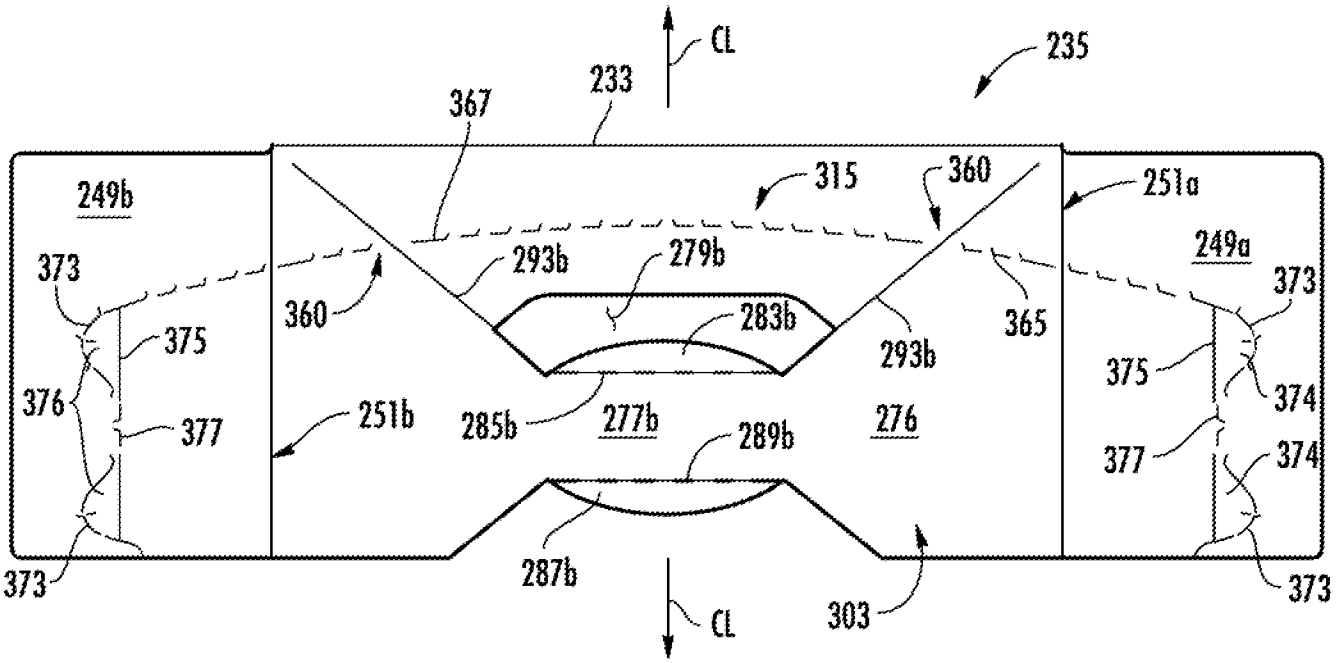

As shown in FIG. 7B, the second dispenser panel 303 can be at least partially defined by a tear line 315 extending from access flaps 374 in the first top end flap 249*a* to access flaps 376 in the second top end flap 249*b*. The tear line 315 includes a first directional portion 365 extending from the access flaps 374 to the centerline CL of the second top panel 235 and a second directional portion 367 extending from the access flaps 376 to the centerline CL of the second top panel 235. The first and second directional portions 365, 367 are configured to be torn from the respective access flaps 374, 376 towards the centerline CL of the second top panel 235. The tear line 315 also includes gaps 360 between the slits forming the tear line proximate the oblique fold lines 293*b*. The slits of the fold line 315 can also be spaced apart at the longitudinal fold lines 251*a*, 251*b*. The access flaps 374, 376 can be defined by cut lines or tear lines 373 in the respective top end flaps 249*a*, 249*b*, and can be foldably connected to the dispenser panel 303 along fold lines 375. A cut or tear line 377 can extend between the access flaps 374 and the between the access flaps 376. The first dispenser panel 301, the second dispenser panel 303, the access openings 370, 372, the access flaps 374, 376, and/or the tear lines 305, 315 can be otherwise shaped, arranged, and/or configured without departing from the disclosure.

Figure 8:
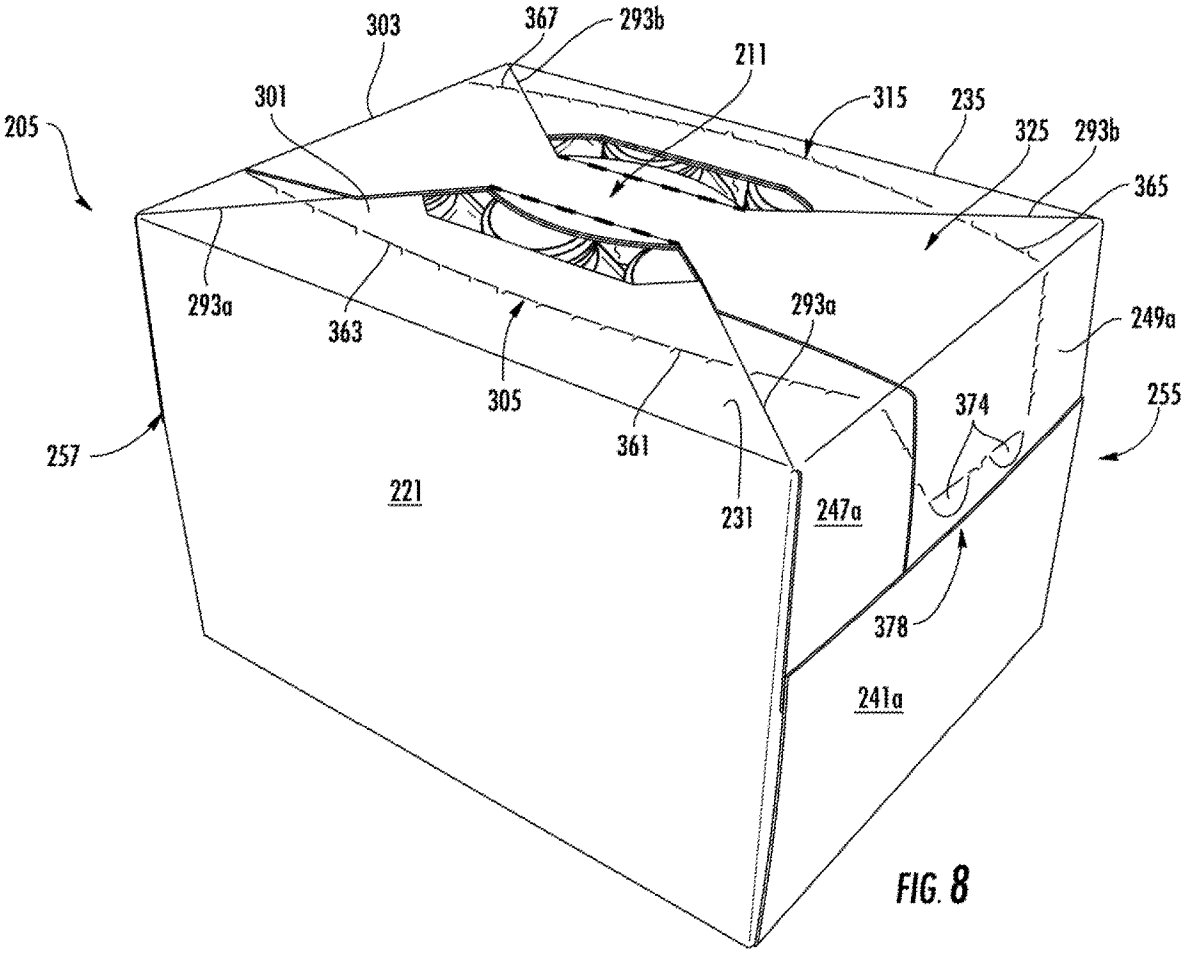
FIG. 8 is a perspective view of the carton assembled from the blank of FIG. 7.

As shown in FIG. 8, the erected carton 205 includes the overlapped top panels 231, 235 with the second dispenser panel 303 overlapping the first dispenser panel 301 to form the dispenser panel 325. Additionally, the handle grip portion 277*b* overlaps the handle grip portion 277*a* in the dispenser panel 325. The access flaps 374, 376 can overlap the respective access openings 370, 372 at the respective closed ends 255, 257 of the carton 205 to form access features 378 at each end.

The dispenser 207 can be opened by initiating tearing at the access features 378 at each end 255, 257. The access feature 378 at the first end 255 of the carton is activated by pushing the access flaps 374 in to the interior of the carton 205, folding along fold lines 375. The access openings 370 provide clearance for the pivoting access flaps 374. In one embodiment, a user uses two fingers to activate the access feature 378 at the first end 255—one finger for each access flap 374. The access feature 378 at the second end 357 of the carton can be similarly activated by folding the access flaps 376 along fold lines 375 past the access openings 372. The dispenser panel 325 can be removed by tearing from one end to approximately the centerline of the top panels 231, 235 and then tearing from the opposite end. Alternatively, the dispenser panels 325 can be removed by tearing from both ends 255, 257 generally simultaneously.

Figure 9:
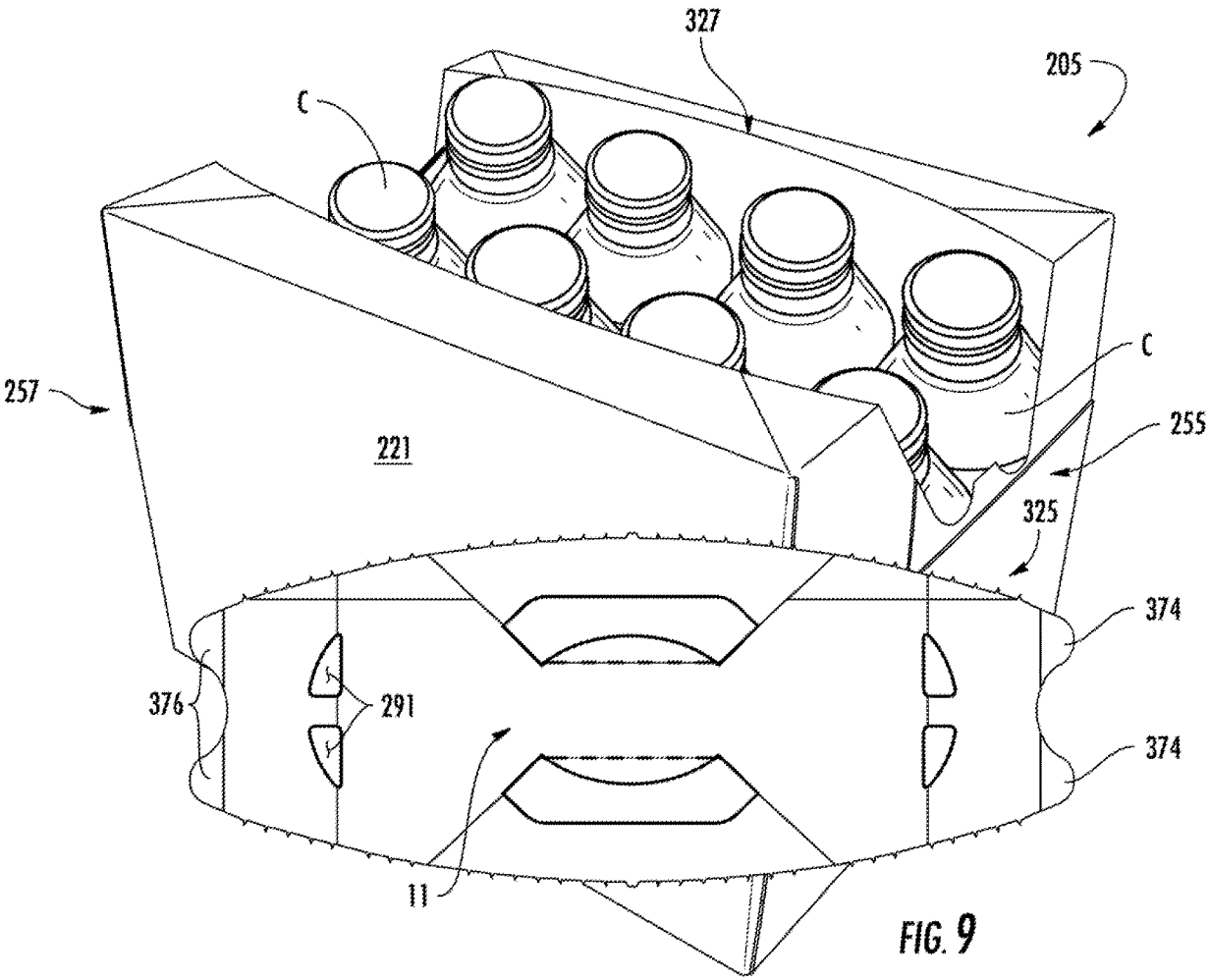
FIG. 9 is a perspective view of the carton of FIG. 8 with a dispenser panel removed to create a dispenser opening.

The opened carton 205 with a dispenser opening 327 and the removed dispenser panel 325 are shown in FIG. 9. The dispenser 207 can be alternatively opened without departing from the disclosure. For example, the dispenser 207 could be opened by initiating tearing at one of the access features 378 at one end 255, 257 and tearing the tear lines 305, 315 from that end to the opposite end.

In one exemplary embodiment, the cartons 5, 205 of the first and second embodiments can be made with 24-point paperboard, which is generally strong enough to support the carton with 12 full containers C at the handles 11, 211 without significant unwanted tearing at the tear lines 105, 115 or 305, 315. Alternatively, other paperboards can be used. For example, the paperboard used can depend on the number, size, contents, and/or the total weight of the containers C contained in the carton 5, 205.

Figure 10:
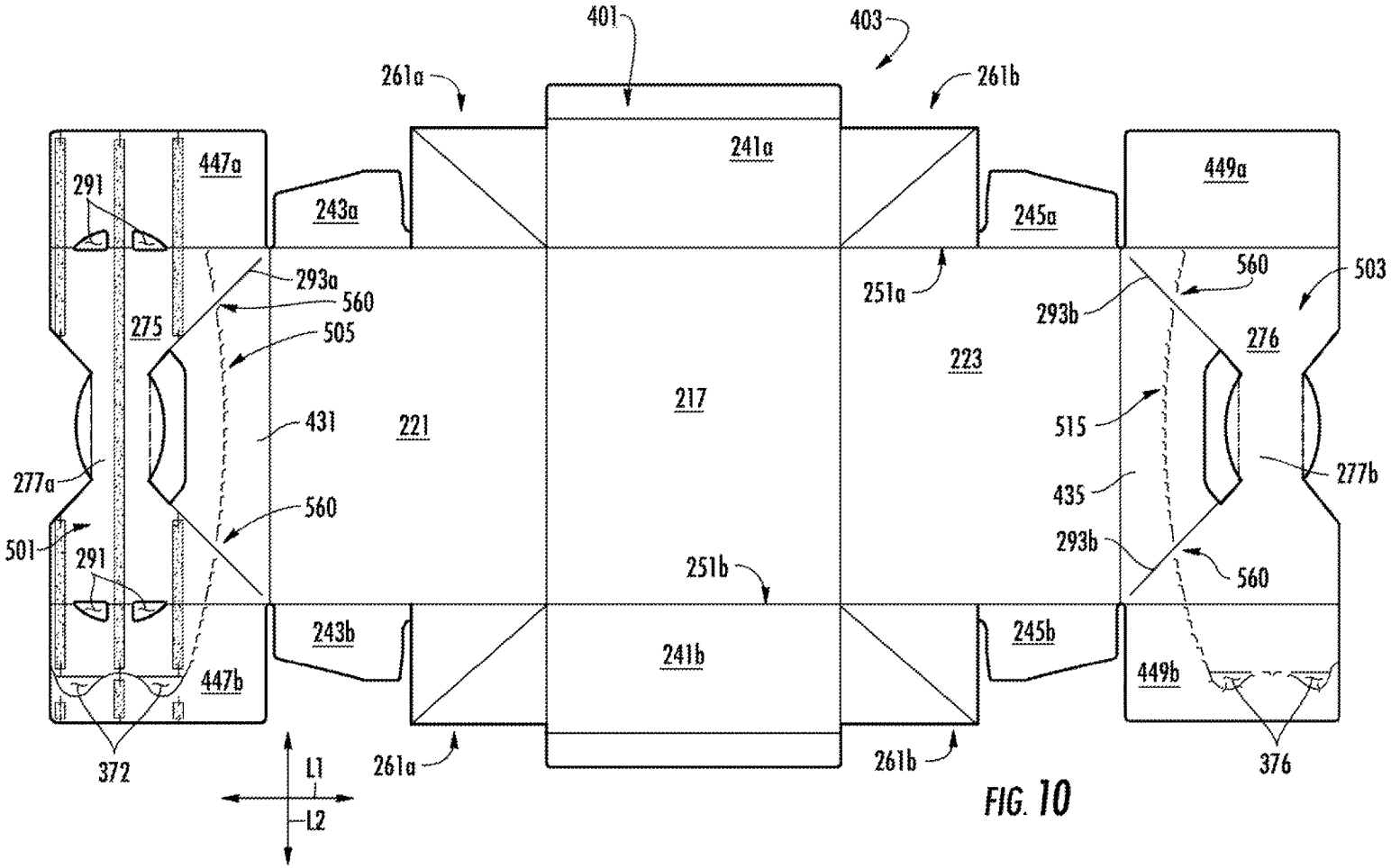
FIG. 10 is a plan view of a blank used to form a carton according to a third embodiment of the disclosure.

FIG. 10 illustrates an interior side 401 of a blank 403 for forming a carton 405 according to a third embodiment of the disclosure. The third embodiment is generally similar to the second embodiment, except for variations noted and variations that will be apparent to one of ordinary skill in the art. Accordingly, similar or identical features of the embodiments have been given like or similar reference numbers. The blank 403 has a longitudinal axis L1 and a lateral axis L2. The carton 405 is illustrated in its erected state in FIGS. 11-14.

Figure 11:
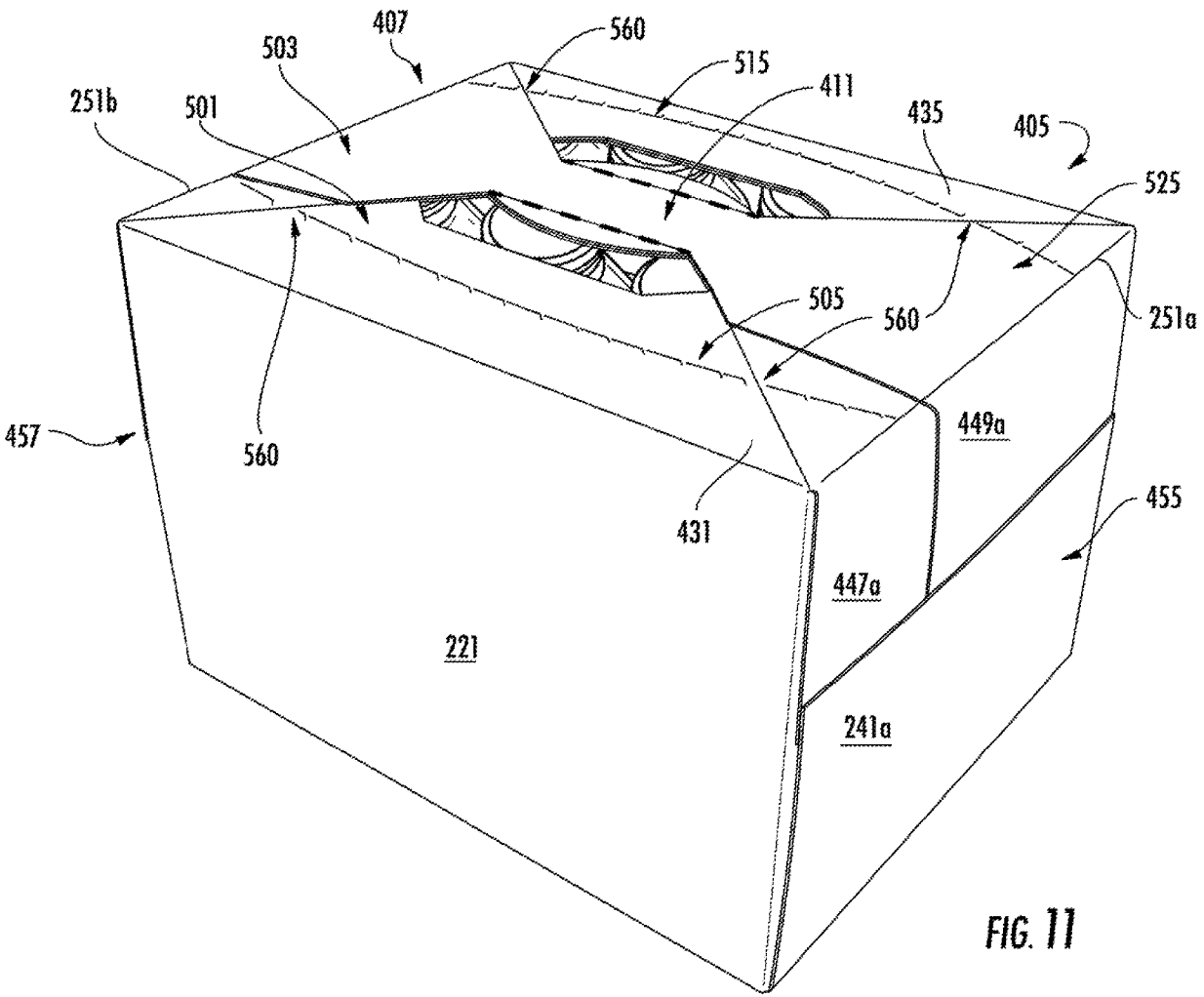
FIGS. 11 and 12 are perspective views of the carton assembled from the blank of FIG. 10.
Figure 12:
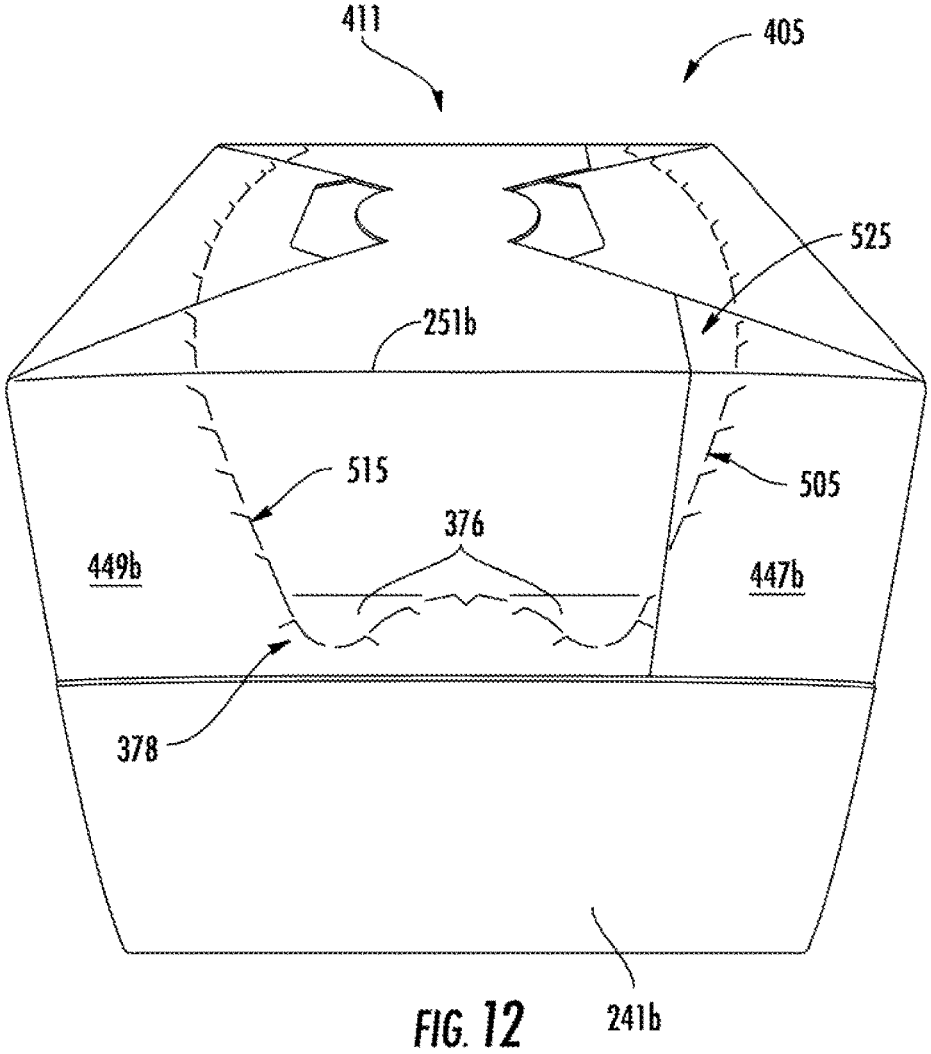

As shown in FIGS. 10-12, the dispenser 407 and the handle 411 are similar to the dispenser 207 and the handle 211 of the second embodiment. However, the first dispenser panel 501 extends in the second top end flap 447*b* and the first top panel 431 to the first longitudinal fold line 451*a*, and the second dispenser panel 503 extends in the second top end flap 449*b* and the second top panel 435 to the first longitudinal fold line 251*a*. The first dispenser panel 501 comprises a tear line 505 extending from the access openings 372 across the second top end flap 447*b* and the first top panel 431 and terminates adjacent the first longitudinal fold line 251*a*. The second dispenser panel 503 comprises a tear line 515 that extends from the access flaps 376 across the second top end flap 449*b* and the second top panel 435 and terminates adjacent the first longitudinal fold line 251*a*. The slits of the tear lines 505, 515 are oriented for tearing from the access openings 372 and access flaps 376 toward the longitudinal fold line 251*a* all the way across the respective top panels 431, 435. The tear lines 505, 515 can include gaps 560 where the slits of the fold lines 505, 515 are spaced apart from the respective oblique fold lines 293*a*, 293*b*. The slits of the fold lines 505, 515 can also be spaced apart at the longitudinal fold lines 251*a*, 251*b*.

As shown in FIGS. 11 and 12, the erected carton 405 includes a dispenser panel 525 formed from the overlapped dispenser panels 501, 503 in the overlapped top panels 431, 435 and the overlapped top end flaps 447*b*, 449*b* in the closed end 457 of the carton 405. The handle 411 is positioned within the dispenser panel 525. The access flaps 376 in the second top end flap 449*b* overlap the access openings 372 in the second top end flap 447*b* to form an access feature 378 in the closed end 457 of the carton 405.

Figure 13:
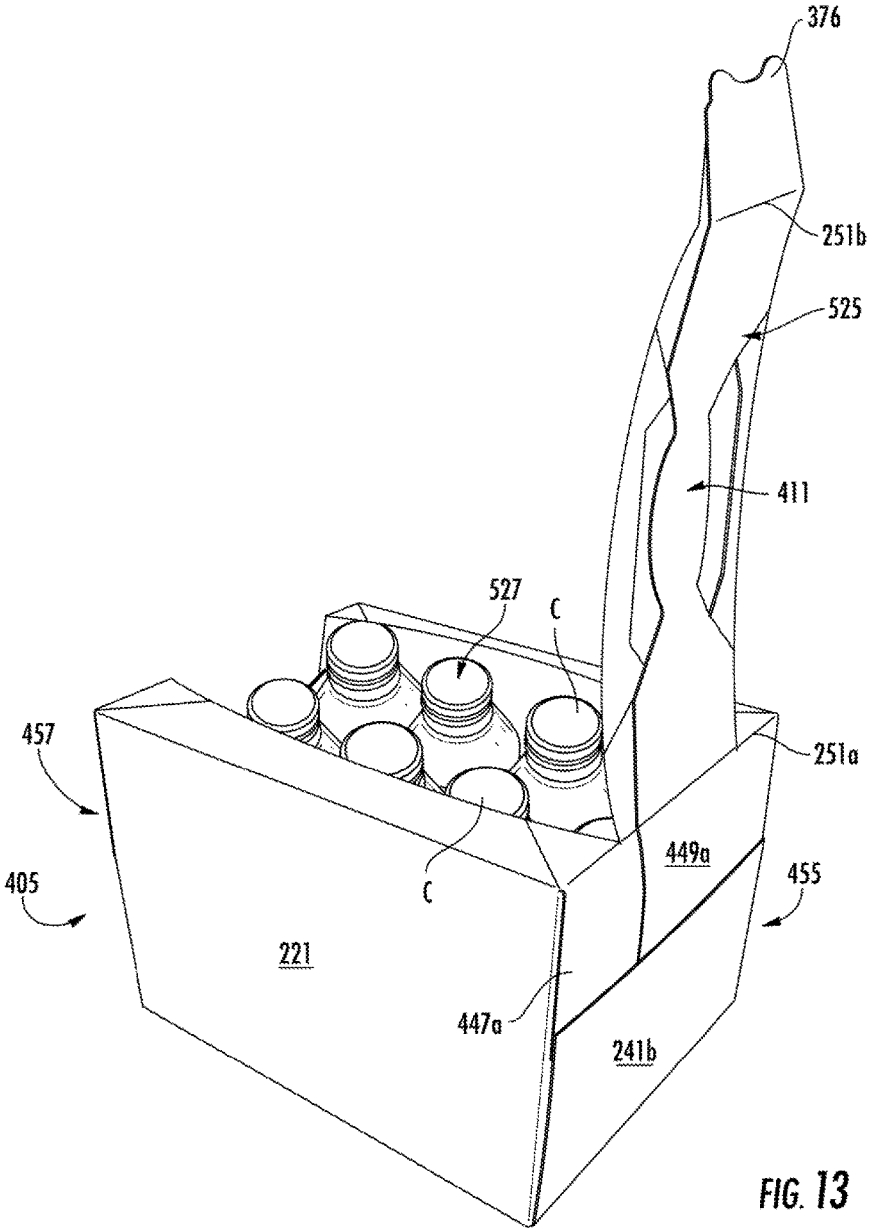
FIGS. 13 and 14 are perspective views of the of the carton of FIGS. 11 and 12 with a dispenser panel pivoted upwardly to create a dispenser opening.
Figure 14:
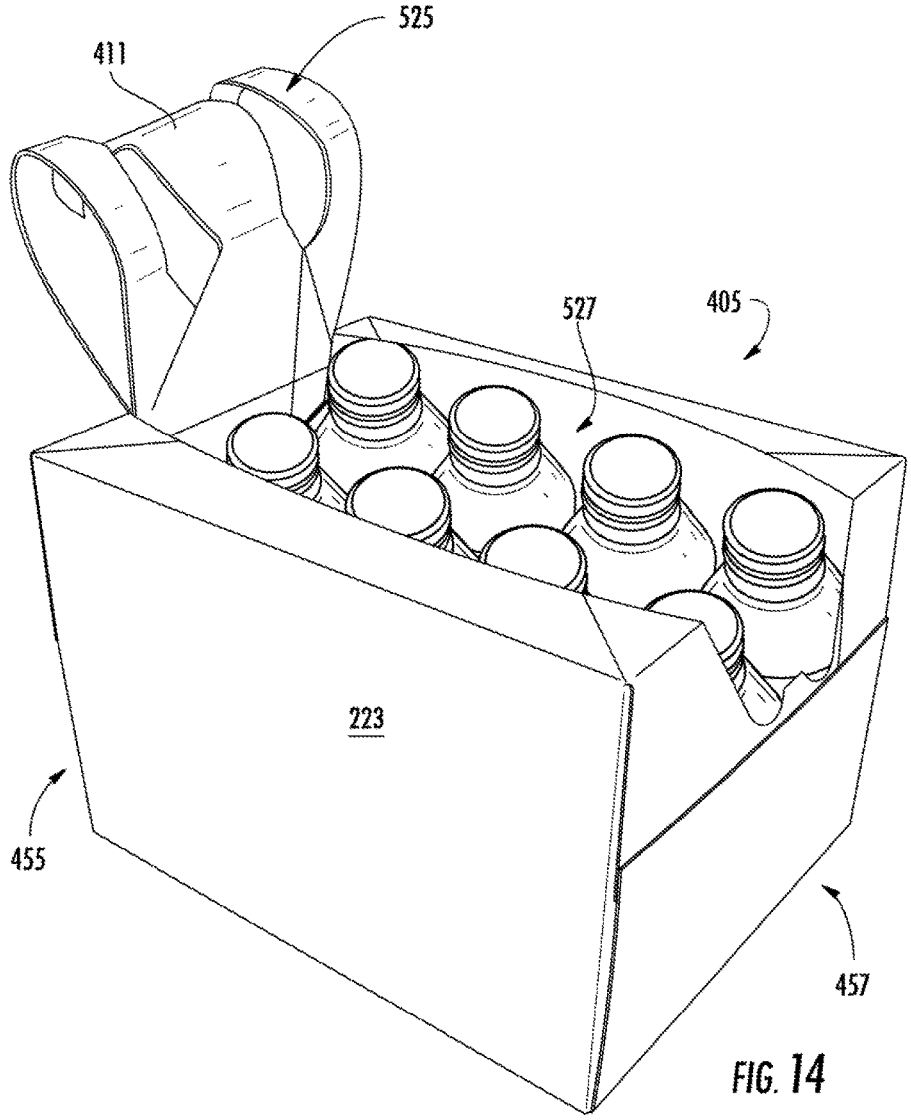

As shown in FIGS. 13 and 14, the dispenser 407 can be activated by pushing the access flaps 376 towards the interior of the carton 405 through the access openings 372 and pulling the dispenser panel 525 outwardly to tear the tear lines 505, 515 from the access feature 378 across the second longitudinal fold line 251*b* and across the top panels 431, 435 to the first longitudinal fold line 251*a*. While tearing along the tear lines 505, 515, the dispenser panel 525 is pivoted upwardly along the first longitudinal fold line 251*a*. Accordingly, a dispenser opening 527 is formed in the carton 405 and the dispenser panel 525 remains attached to the carton 405. Additionally, the handle 411 is substantially removed from the top of the carton 405 when the dispenser 407 is activated. The dispenser panel 525 optionally can be folded and tucked into the dispenser opening 527 at the closed end 455 of the carton 405 as shown in FIG. 14.

The dispenser 407 can be otherwise shaped, arranged, and/or configured without departing from the disclosure. For example, the dispenser panel 525 could be foldably connected to the top panels 431, 435 of the carton along fold lines that extend in the respective top panels 431, 435 and that are spaced apart from the first longitudinal fold line 251*a*. Alternatively, the dispenser panel 525 can be foldably connected to the closed end 455 by fold lines that extend in the respective first top end flaps 447*a*, 449*a* and that are spaced apart from the first longitudinal fold line 251*a*.

Figure 15:
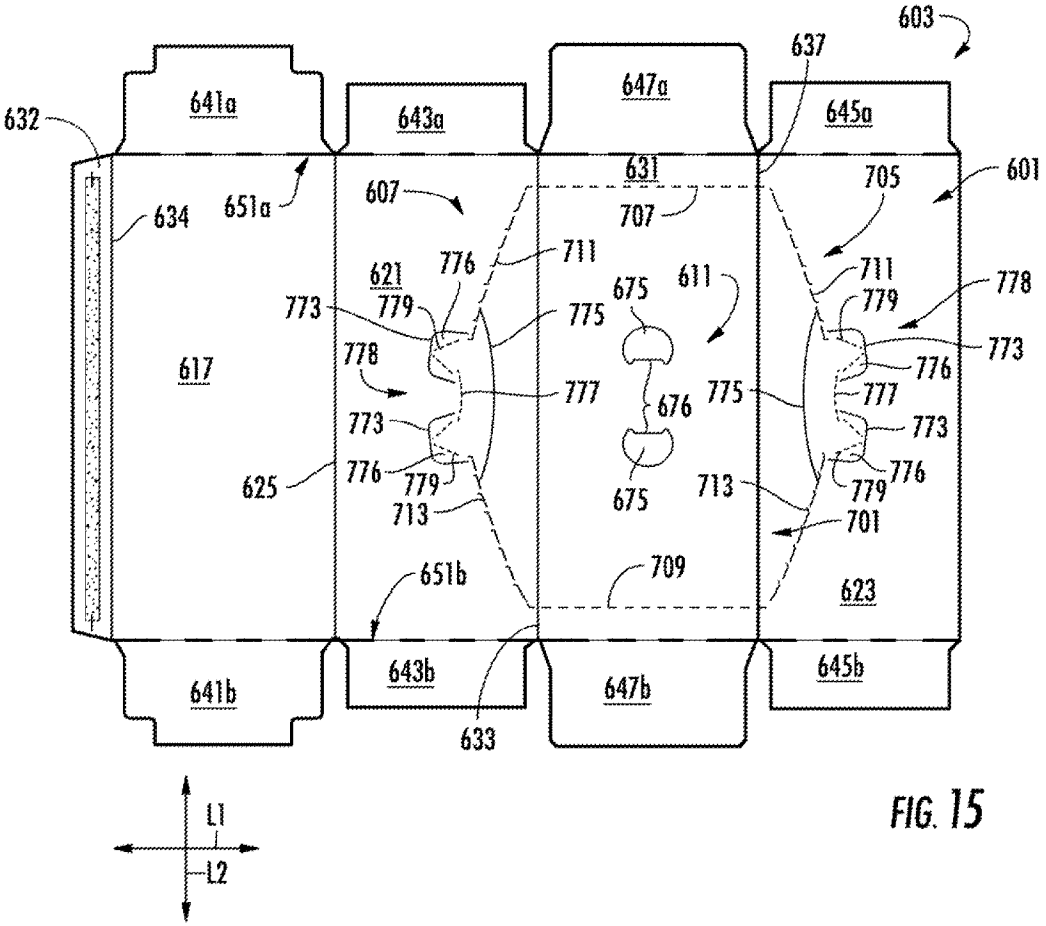
FIG. 15 is a plan view of a blank used to form a carton according to a fourth embodiment of the disclosure.

FIG. 15 illustrates an interior side 601 of a blank 603 for forming a carton 605 according to a fourth embodiment of the disclosure. The fourth embodiment is generally similar to the previous embodiments, except for variations noted and variations that will be apparent to one of ordinary skill in the art. Accordingly, similar or identical features of the embodiments have been given like or similar reference numbers. The blank 603 has a longitudinal axis L1 and a lateral axis L2. The carton 605 is illustrated in its erected state in FIGS. 16-19. The carton 605 includes a dispenser 607 with a single-ply dispenser panel 701. A handle 611 extends in the dispenser panel 701.

In the illustrated embodiment, the carton 605 is sized to house ten containers C in a single layer in a 2×5 arrangement, but it is understood that the carton may be sized and shaped to hold containers of a different or same quantity in more than one layer and/or in different row/column arrangements (e.g., 1×6, 3×6, 3×4, 2×6, 2×6×2, 3×4×2, 2×9, etc.). In the illustrated embodiment, the containers C can be 7.5-oz cans (e.g., aluminum cans); however, the containers C alternatively can be any style of container.

As shown in FIG. 15, the blank 603 includes a bottom panel 617, a first side panel 621 foldably connected to the bottom panel 617 along a lateral fold line 625, a top panel 631 foldably connected to the first side panel 621 along a lateral fold line 633, and a second side panel 623 foldably connected to the top panel 631 along a lateral fold line 637. An attachment flap 632 can be foldably connected to the bottom panel 617 along a lateral fold line 634. The attachment flap 632 can be adhered to the interior surface of the second side panel 623 when erecting the carton 605. Alternatively, the attachment flap can be foldably connected to the second side panel 623 for being adhered to the bottom panel 617 when the carton is erected.

The bottom panel 617 is foldably connected to a first bottom end flap 641*a* and a second bottom end flap 641*b*. The first side panel 621 is foldably connected to a first side end flap 643*a* and a second side end flap 643*b*. The second side panel 623 is foldably connected to a first side end flap 645*a* and a second side end flap 645*b*. The top panel 631 is foldably connected to a first top end flap 647*a* and a second top end flap 647*b*.

The end flaps 641*a*, 643*a*, 645*a*, 647*a* extend along a first marginal area of the blank 603, and are foldably connected at a first longitudinal fold line 651*a* that extends along the length of the blank. The end flaps 641*b*, 643*b*, 645*b*, 647*b* extend along a second marginal area of the blank 603, and are foldably connected at a second longitudinal fold line 651*b* that also extends along the length of the blank. When the carton 605 is erected, the end flaps 641*a*, 643*a*, 645*a*, 647*a* close a first end 655 of the carton, and the end flaps 641*b*, 643*b*, 645*b*, 647*b* close a second end 657 of the carton. In accordance with an alternative embodiment of the present disclosure, different flap arrangements can be used for closing the ends 655, 657 of the carton 605.

In the illustrated embodiment, the features that form the dispenser 607 in the carton 605 include the dispenser panel 701 in the top panel 631 and the side panels 621, 623. The dispenser panel 701 is formed by a tear line 705 comprising longitudinal portions 707, 709 extending in the top panel 631 and into the side panels 621, 632, and side portions 711, 713 extending from respective ends of the longitudinal portions 707, 709 in the first side panel 621 and the second side panel 623. In one embodiment, at least the side portions 711, 713 of the tear line 705 are directional portions, which can be similar to the directional portions 161, 163, 165, 167. Accordingly, the side portions 711, 713 can be configured to tear more easily from the access features 778 upwardly than from the top panel 631 into the side panels 621, 623. This configuration can help avoid unwanted tearing of the carton 605 at the tear line 705 while carrying the carton at the handle 611. In the illustrated embodiment, the dispenser 607 further includes respective access features 778 in the first side panel 621 and the second side panel 623. Each of the access features can include access flaps 776 at least partially defined by cuts 773. Alternatively, the cuts 773 could be tear lines. A tear line 777 can extend between the access flaps 776. The access features 778 can be defined by respective curved scores 775 extending in the dispenser panel 701 from the respective side portions 711 to the respective side portions 713. In one embodiment, a generally V-shaped fold line 779 can extend in each of the access flaps 776 to help the access flaps deform (e.g., around the containers C) as the access flaps are folded into the interior of the carton 605 when activating the access features 778. The dispenser panel 701, the tear line 705, and/or the access features 778 can be omitted or otherwise shaped, arranged, and/or configured without departing from the disclosure.

The features that comprise the handle 611 include handle flaps 675 in the top panel 631, within the dispenser panel 701. The handle flaps 675 are foldably connected to the top panel 631 along respective longitudinal fold lines 676. The handle flaps 675 could be otherwise shaped, arranged, and/or configured without departing from the disclosure, and the blank 603 could have other features for forming the handle 611 without departing from the disclosure. For example, the handle flaps could be omitted, and the handle could include handle apertures in the top panel. Alternatively, or in addition, any suitable handle style can be used with the carton 605.

Figure 16:
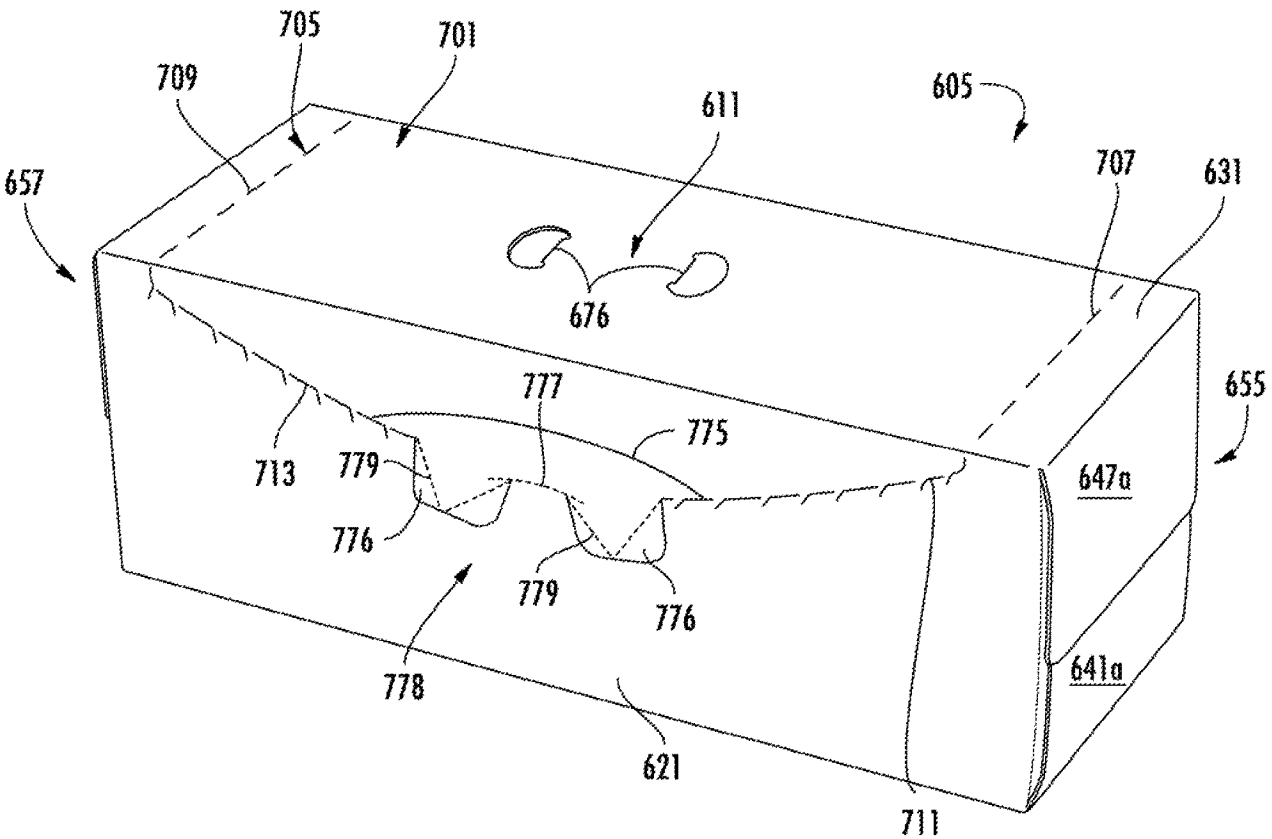
FIG. 16 is a perspective view of the carton assembled from the blank of FIG. 15.
Figure 17:
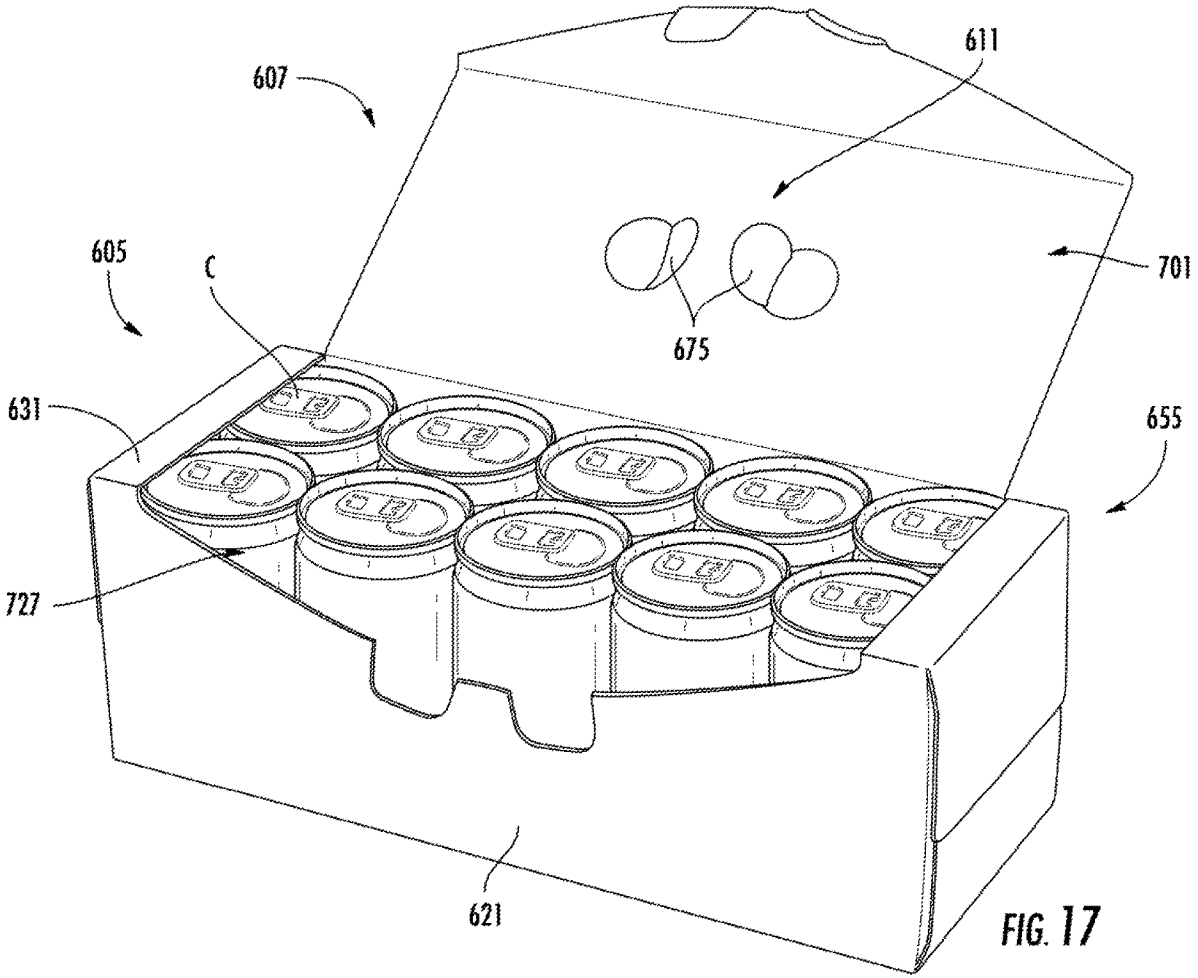
FIG. 17 is a perspective view of the of the carton of FIG. 16 with a dispenser panel partially removed to create a dispenser opening.

The erected carton 605 is shown in FIG. 16 with the handle flaps 675 inwardly folded for carrying the carton. As shown in FIG. 17, the dispenser 607 can be activated by initiating tearing at the access features 778 and folding the dispenser panel 701 upwardly. A user can push the access flaps 776 into the interior of the carton, folding the access feature inwardly along the curved score 775. The dispenser panel 701 can then be grasped at the opening formed at the access feature 778 and be pulled outwardly and upwardly to tear the tear line 705 along the side portions 711, 713 and the longitudinal portions 707, 709. The tearing can be initiated at one access feature 778 or at both access features 778 simultaneously. For example, the tearing can be initiated at the access feature 778 in the first side panel 621, and the dispenser panel 701 can be pivoted upwardly, as shown in FIG. 17, to form a dispenser opening 727. In one embodiment, the configuration of the access features 778 (e.g., having two access flaps 776 for each access feature) can help a user open the carton at least because the user can grasp the dispenser panel 701 with multiple fingers at the access features 778. Accordingly, the tear line 705 can be configured to be harder to tear (e.g., thicker panel material and/or larger spacing between cuts) than other tear lines used with less convenient access features. This can further help avoid unwanted tearing of the carton at the tear line 705 when carrying the carton at the handle 611. The dispenser panel 701 can be fully removed, in one embodiment, by continuing to tear along the tear line 705, and/or actuating the access feature 778 in the second side panel 623 and tearing along the side portions 711, 713 of the tear line in the second side panel. The carton 605 can be opened by alternative steps without departing from the disclosure.

Figure 18:
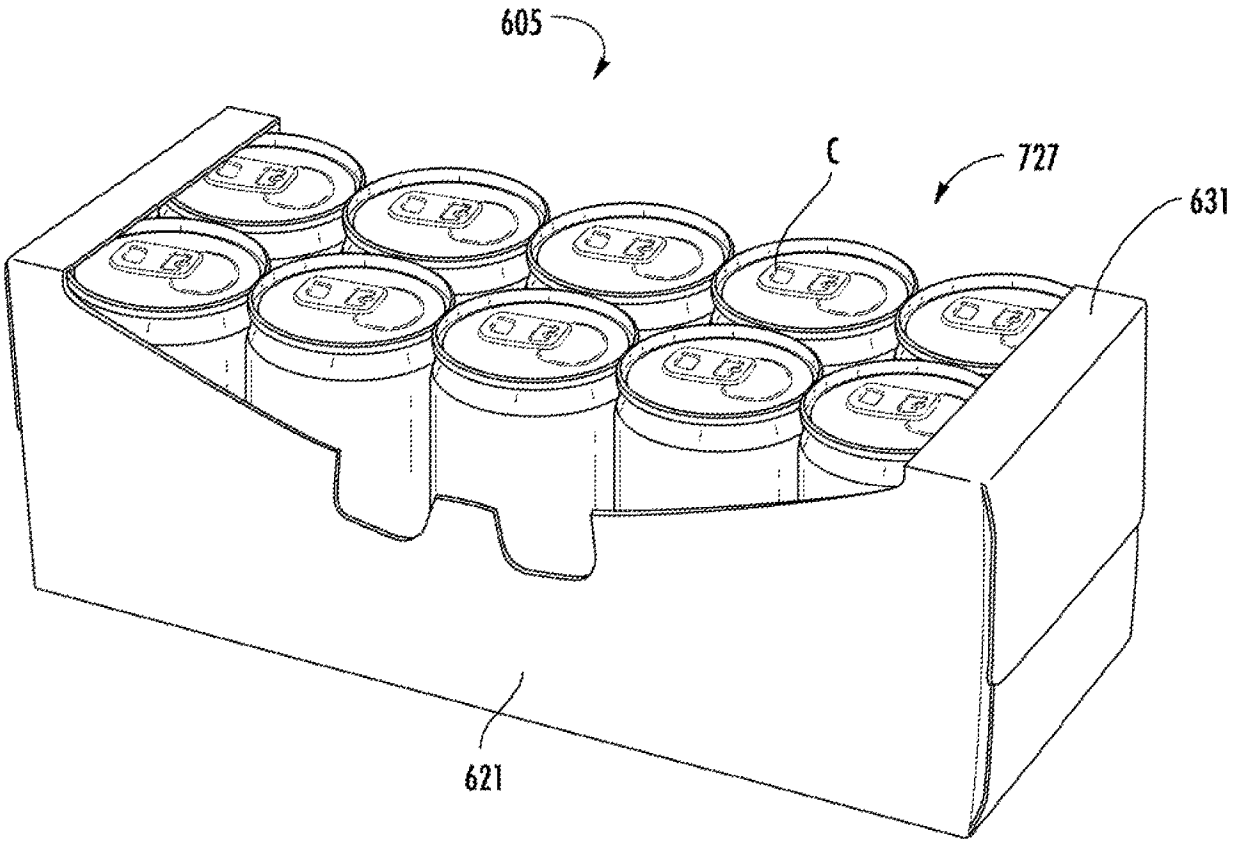
FIGS. 18 and 19 are perspective views of the carton of FIG. 17 with the dispenser panel removed.
Figure 19:
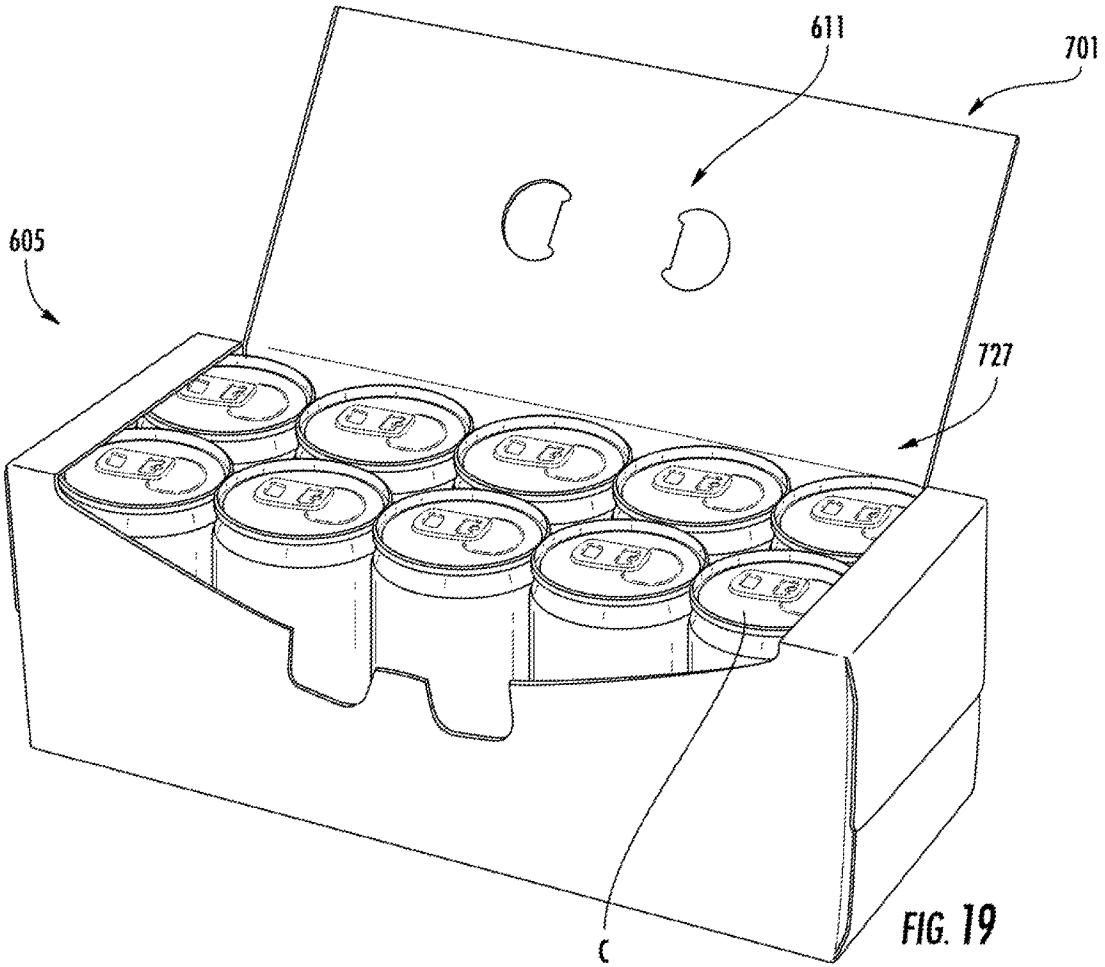

As shown in FIGS. 18 and 19, the dispenser panel 701 is fully removed with the handle 611. The dispenser panel 701 can be tucked into the opened carton 605 for display. As shown in FIG. 19, for example, the dispenser panel 701 can be inserted into the dispenser opening 727 between a row of containers C and one of the first side panel 621 and the second side panel 623. The carton 605, the dispenser 607, and/or the handle 611 could be otherwise shaped, arranged, and/or configured without departing from the disclosure.

Figure 20:
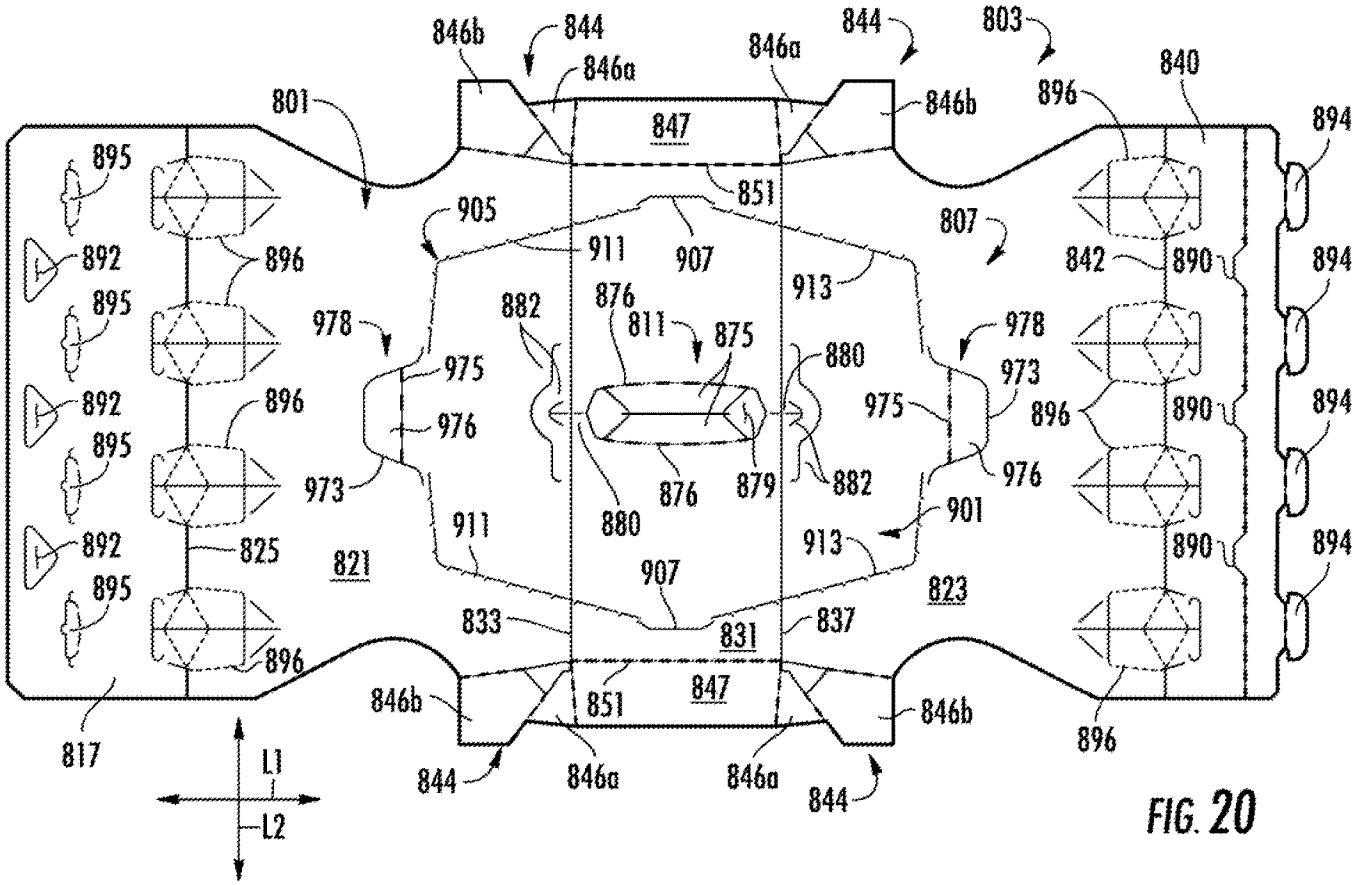
FIG. 20 is a plan view of a blank used to form a carton according to a fifth embodiment of the disclosure.

FIG. 20 illustrates an interior side 801 of a blank 803 for forming a carton or wrap 805 according to a fifth embodiment of the disclosure. The fifth embodiment is generally similar to the fourth embodiment, except for variations noted and variations that will be apparent to one of ordinary skill in the art. Accordingly, similar or identical features of the embodiments have been given like or similar reference numbers. The blank 803 has a longitudinal axis L1 and a lateral axis L2. The wrap 805 is illustrated in its erected state in FIGS. 21-24, wherein the blank 803 is formed into the wrap 805 around containers C to form a package 806. The wrap 805 includes a dispenser 807 with a single-ply dispenser panel 901. A handle 811 extends in the dispenser panel 901.

In the illustrated embodiment, the carton 805 is sized to house eight containers C in a single layer in a 2×4 arrangement, but it is understood that the carton may be sized and shaped to hold containers of a different or same quantity in more than one layer and/or in different row/column arrangements (e.g., 1×6, 3×6, 3×4, 2×6, 2×6×2, 3×4×2, 2×9, etc.). In the illustrated embodiment, the containers C can be 12-oz plastic bottles; however, the containers C alternatively can be any style of container.

As shown in FIG. 20, the blank 803 includes a first bottom panel 817, a first side panel 821 foldably connected to the first bottom panel 817 along a lateral fold line 825, a top panel 831 foldably connected to the first side panel 821 along a lateral fold line 833, a second side panel 823 foldably connected to the top panel 831 along a lateral fold line 837, and a second bottom panel 840 foldably connected to the second side panel 823 along a lateral fold line 842. Top end flaps 847 can be foldably connected to opposite ends of the top panel 831 along respective longitudinal fold lines 851. Additionally, a gusset 844 can be disposed adjacent each of the four corners of the top panel 831. Each gusset 844 can comprise a first gusset panel **846*a* foldably connected to an end of one of the end flaps 847 and a second gusset panel 846*b* foldably connected to one of the first and second side panels 821, 823. The first gusset panels 846*a* can be foldably connected to the respective second gusset panels 846*b* along oblique fold lines. The end flaps 847 and/or the gussets 844** can be omitted or otherwise shaped, arranged, and/or configured without departing from the disclosure.

Figure 21:
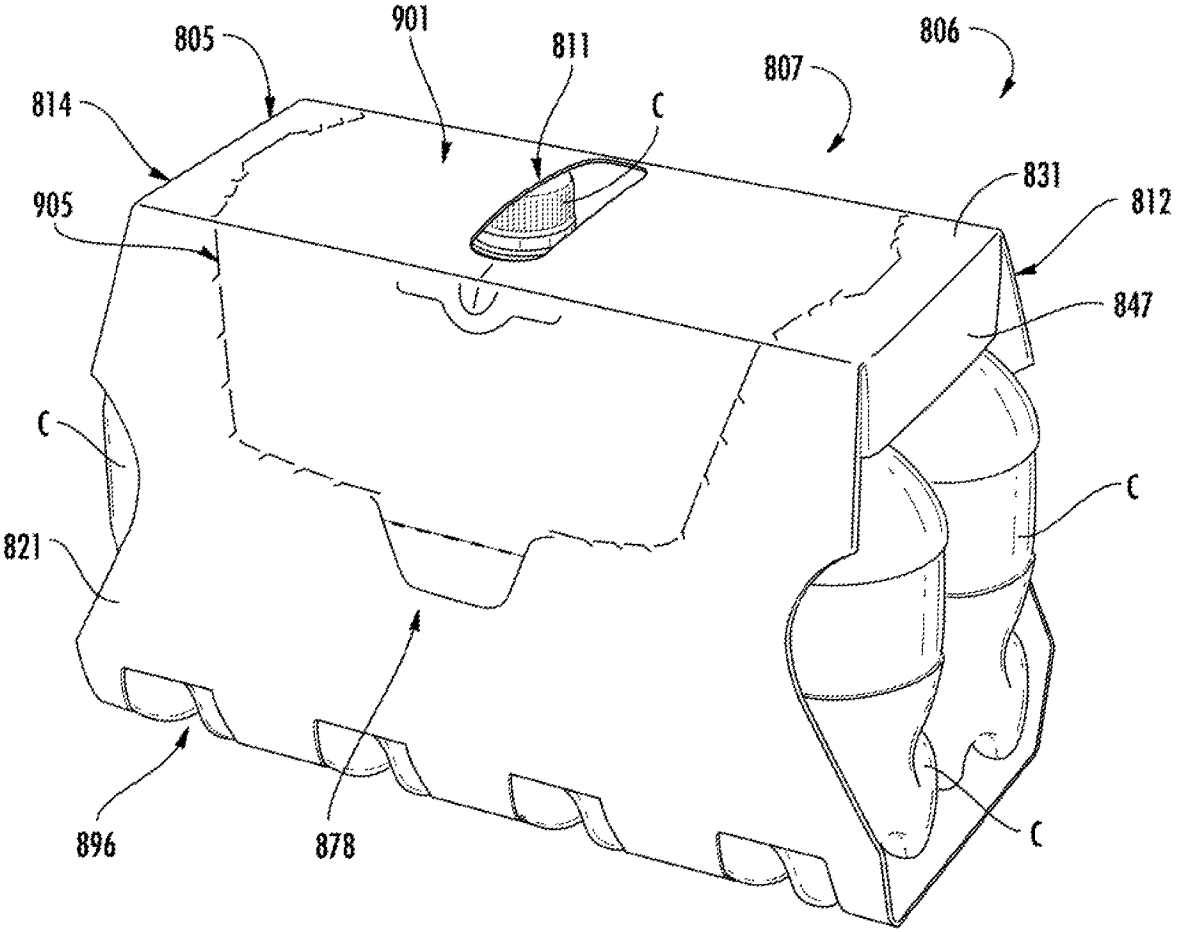
FIG. 21 is a perspective view of the carton assembled from the blank of FIG. 20.

As shown in FIG. 20, the second bottom panel 840 includes three primary male locking features 890 for interlocking with respective primary female locking apertures 892 in the first bottom panel 817 when the carton 805 is erected. The second bottom panel 840 further includes four secondary male locking features 894 for interlocking with respective secondary female locking features 895 in the first dispenser panel 817. In the illustrated embodiment, four retaining features 896 can extend in the first bottom panel 817 and the first side panel 821, interrupting the lateral fold line 825. Similarly, four retaining features 896 can extend in the second bottom panel 840 and the second side panel 823, interrupting the lateral fold line 842. The retaining features can include panels or flaps that engage the bottoms of the respective containers C in the package 806 and that form openings in the wrap 805 for at least partially receiving the bottoms of the containers C (FIG. 21). The bottom panels 817, 840, the primary male locking features 890, the primary female locking features 892, the secondary male locking features 894, the secondary female locking features 895, and/or the retaining features 896 can be omitted or otherwise shaped, arranged, and/or configured without departing from the disclosure. For example, any suitable number of locking features can be included and/or the bottom panels 817, 840 could be glued together to form the wrap 805.

In the illustrated embodiment, the features that form the dispenser 807 in the wrap 805 include the dispenser panel 901 in the top panel 831 and the side panels 821, 823. The dispenser panel 901 is formed by a tear line 905 extending in the top panel 831 and into the side panels 821, 832. The dispenser 807 further includes respective access features 978 in the first side panel 821 and the second side panel 823. Each of the access features 978 can include at least one access flap 976 at least partially defined by a cut 973. Alternatively, the cuts 973 could be tear lines. The access flaps 976 can be further defined by respective fold lines 975 extending in the dispenser panel 901. The dispenser panel 901, the tear line 905, and/or the access features 978 can be omitted or otherwise shaped, arranged, and/or configured without departing from the disclosure.

As shown in FIG. 20, the tear line 905 can include top portions 907 (e.g., cut lines) extending in the top panel 831 and directional portions 911, 913 extending from the top portions 907 in the top panel 831 and into the respective side panels 821, 823. In one embodiment, the directional portions 911, 913 can extend adjacent the respective access features 978 in the respective side panels 821, 823. As described with respect to the previous embodiments above, the directional portions 911, 913 of the tear line 905 can be configured to tear more easily from the access features 978 toward the top portions 907 in the top panel 831. Accordingly, the configuration of the tear line 905 can help avoid unwanted tearing of the wrap 805 when carrying the package 806 at the handle 811 (e.g., the directional portions 911, 913 of the tear line are less likely to tear from the top panel 831 when supporting the package at the handle).

The features that comprise the handle 811 include handle flaps 875 in the top panel 831, within the dispenser panel 901. The handle flaps 875 are foldably connected to the top panel 831 along respective fold lines 876 adjacent a handle aperture 879. The handle 811 can include longitudinal cuts or tear lines 880 that are generally aligned with the centerline of the handle 811 and that extend from the handle aperture 879 in the top panel 831 and into the side panels 821, 823. The tear lines 880 can tear to expand the handle opening when a user grasps the handle 811. Scores 882 in the side panels 821, 823 can act as tear stops to prevent excessive tearing of the wrap 805 at the tear lines 880 and can help redirect forces on the wrap from supporting the weight of the package 806 at the handle 811. The handle 811 could be otherwise shaped, arranged, and/or configured without departing from the disclosure, and the blank 803 could have other features for forming the handle 811 without departing from the disclosure. For example, the handle flaps could be omitted.

Figure 22:
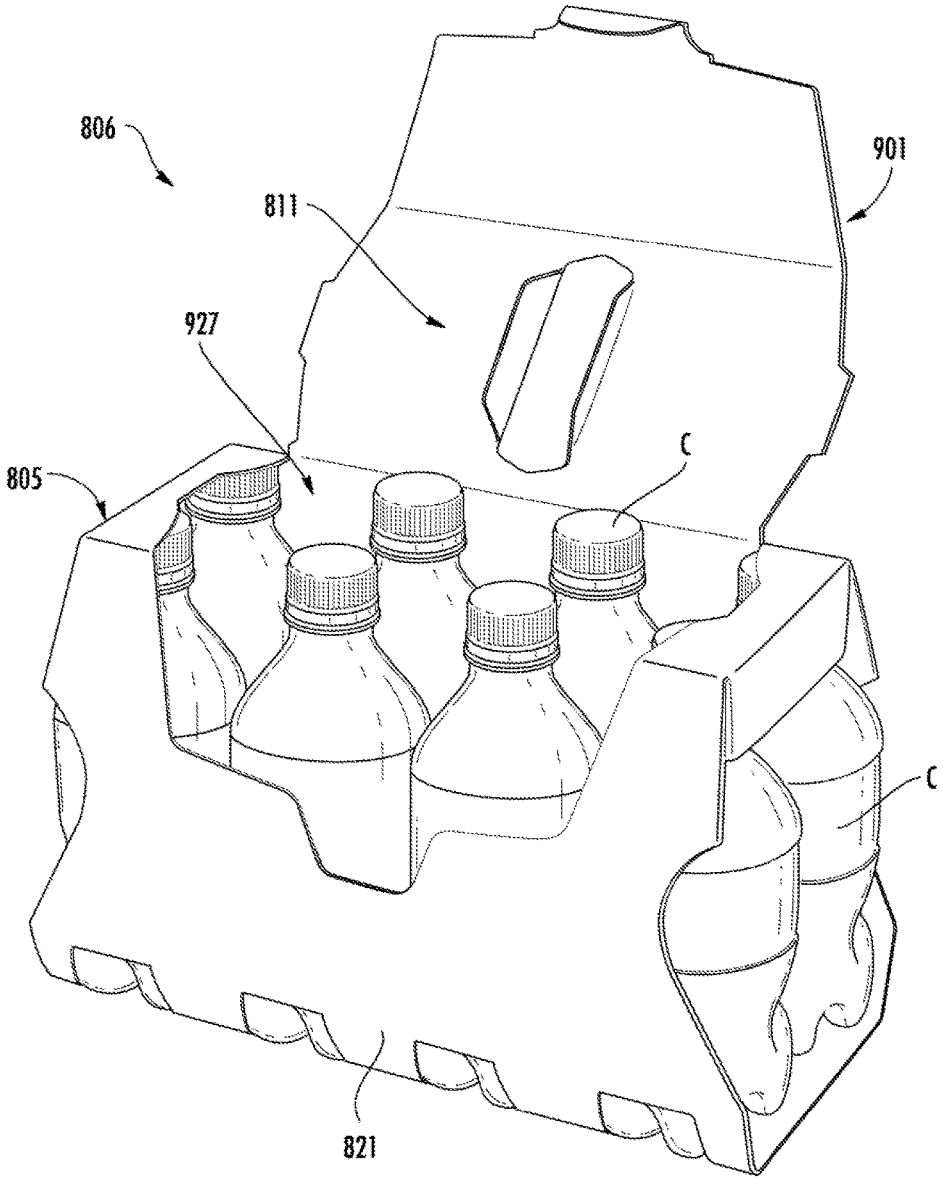
FIG. 22 is a perspective view of the of the carton of FIG. 21 with a dispenser panel partially removed to create a dispenser opening.

The assembled package 806 is shown in FIG. 21 with the handle flaps 875 inwardly folded for carrying the package. As shown in FIG. 22, the dispenser 807 can be activated by initiating tearing at the access features 978. A user can push the access flaps 976 into the interior of the wrap 805, folding the access feature inwardly along the fold line 975. The dispenser panel 901 can then be grasped at the opening formed at the access feature 978 and be pulled outwardly and upwardly to tear along the tear line 905. The tearing can be initiated at one access feature 978 or at both access features 978 simultaneously. For example, the tearing can be initiated at the access feature 978 in the first side panel 821 and the dispenser panel 901 can be pivoted upwardly as shown in FIG. 22 to form a dispenser opening 927. The dispenser panel 901 can be fully removed, in one embodiment, by continuing to tear along the tear line 905, and/or actuating the access feature 778 in the second side panel 823 and tearing along the side portions 913 of the tear line in the second side panel. The wrap 805 can be opened by alternative steps without departing from the disclosure.

Figure 23:
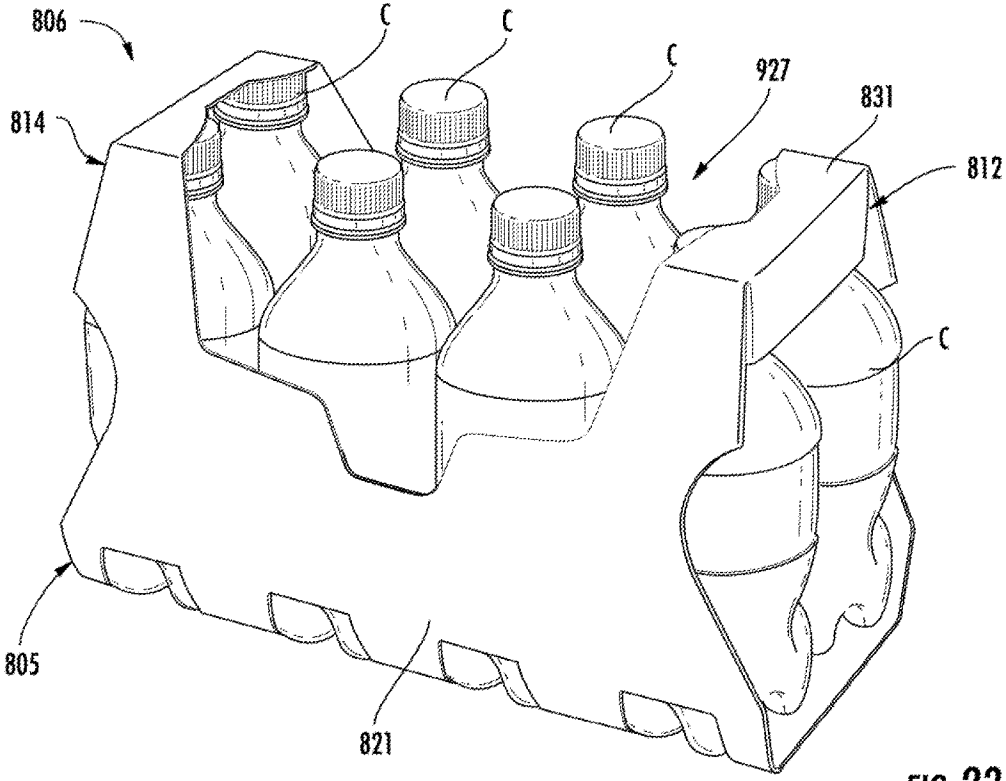
FIGS. 23 and 24 are perspective views of the carton of FIG. 22 with the dispenser panel removed.
Figure 24:
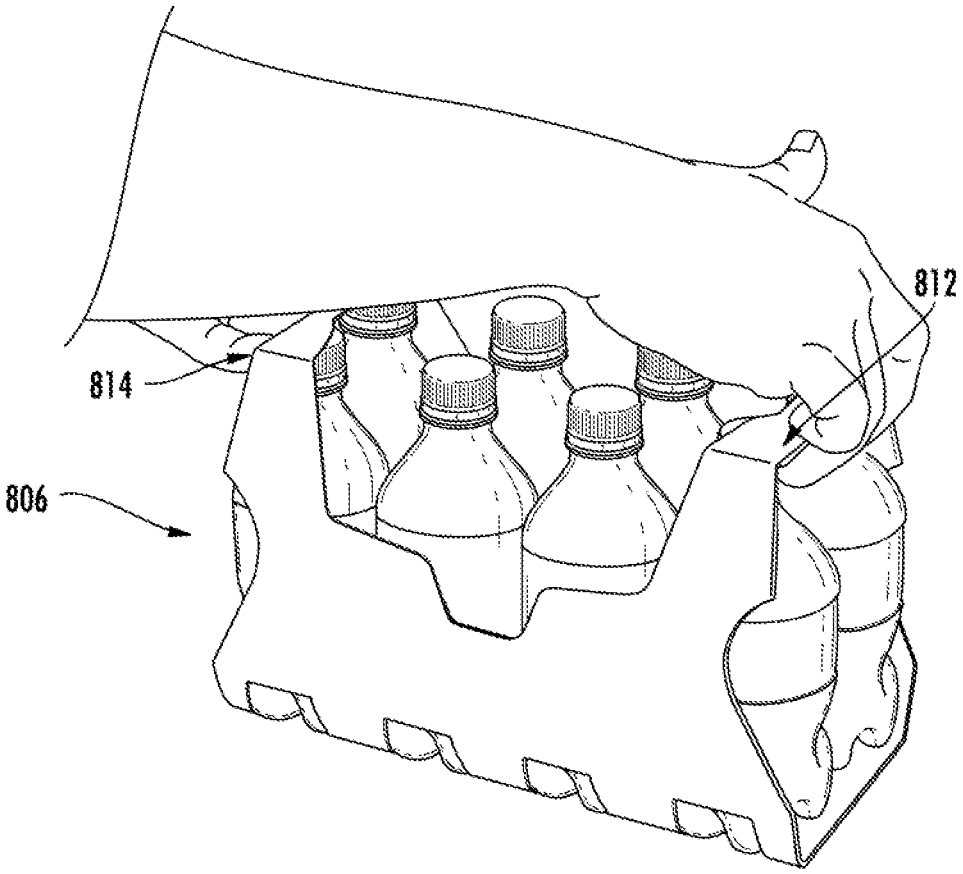

As shown in FIGS. 23 and 24, the dispenser panel 901 is fully removed with the handle 811. As shown in FIG. 24, the package 806 still can be carried after removal of the handle 811 with the dispenser panel 901 by grasping the end structures or secondary handles 812, 814 formed by the end panels 847, the gussets 844, and the portions of the top panel 831 remaining after removal of the dispenser panel 901. In one embodiment, the dispenser panel 901 can be tucked into the opened wrap 805 for display. For example, similarly to the configuration of the carton 605 of the fourth embodiment shown in FIG. 19, the dispenser panel 901 can be inserted into the dispenser opening 927 between a row of containers C and one of the first side panel 821 and the second side panel 823.

Figure 25:
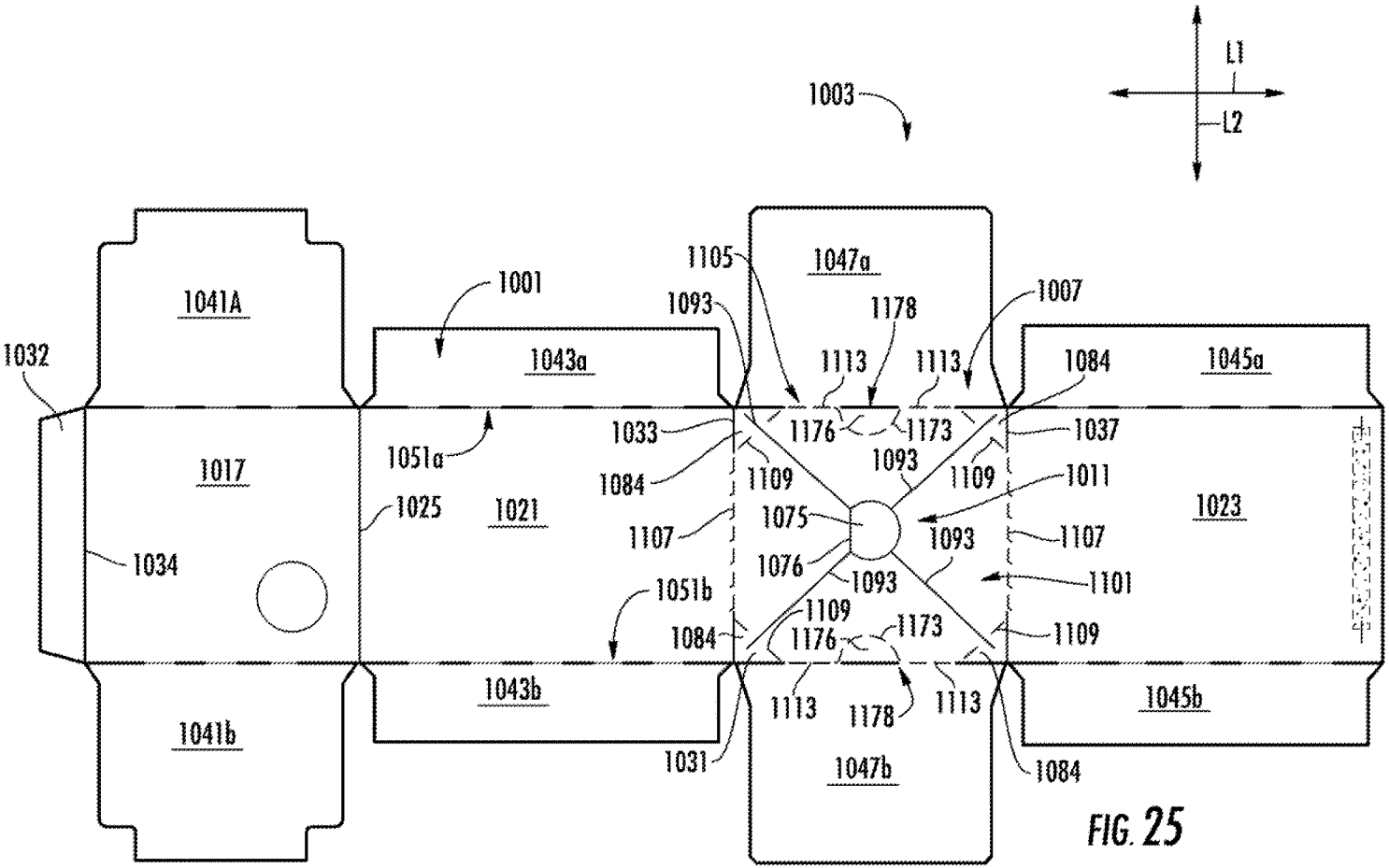
FIG. 25 is a plan view of a blank used to form a carton according to a sixth embodiment of the disclosure.

FIG. 25 illustrates an interior side 1001 of a blank 1003 for forming a carton 1005 according to a sixth embodiment of the disclosure. The sixth embodiment is generally similar to the fourth embodiment, except for variations noted and variations that will be apparent to one of ordinary skill in the art. Accordingly, similar or identical features of the embodiments have been given like or similar reference numbers. The blank 1003 has a longitudinal axis L1 and a lateral axis L2. The carton 1005 is illustrated in its erected state in FIGS. 26-27. The carton 1005 includes a dispenser 1007 with a single-ply dispenser panel 1101. A handle 1011 extends in the dispenser panel 1101.

In the illustrated embodiment, the carton 1005 is sized to house four containers C in a single layer in a 2×2 arrangement, but it is understood that the carton may be sized and shaped to hold containers of a different or same quantity in more than one layer and/or in different row/column arrangements (e.g., 1×6, 3×6, 3×4, 2×6, 2×6×2, 3×4×2, 2×9, etc.). In the illustrated embodiment, the containers C can be 12-oz slim cans (e.g., aluminum cans); however, the containers C alternatively can be any style of container.

As shown in FIG. 25, the blank 1003 includes a bottom panel 1017, a first side panel 1021 foldably connected to the bottom panel 1017 along a lateral fold line 1025, a top panel 1031 foldably connected to the first side panel 1021 along a lateral fold line 1033, and a second side panel 1023 foldably connected to the top panel 1031 along a lateral fold line 1037. An attachment flap 1032 can be foldably connected to the bottom panel 1017 along a lateral fold line 1034. The attachment flap 1032 can be adhered to the interior surface of the second side panel 1023 when erecting the carton 1005. Alternatively, the attachment flap can be foldably connected to the second side panel 1023 for being adhered to the bottom panel 1017 when the carton is erected.

The bottom panel 1017 is foldably connected to a first bottom end flap 1041*a* and a second bottom end flap 1041*b*. The first side panel 1021 is foldably connected to a first side end flap 1043*a* and a second side end flap 1043*b*. The second side panel 1023 is foldably connected to a first side end flap 1045*a* and a second side end flap 1045*b*. The top panel 1031 is foldably connected to a first top end flap 1047*a* and a second top end flap 1047*b*.

The end flaps 1041*a*, 1043*a*, 1045*a*, 1047*a* extend along a first marginal area of the blank 1003, and are foldably connected at a first longitudinal fold line 1051*a* that extends along the length of the blank. The end flaps 1041*b*, 1043*b*, 1045*b*, 1047*b* extend along a second marginal area of the blank 1003, and are foldably connected at a second longitudinal fold line 1051*b* that also extends along the length of the blank. When the carton 1005 is erected, the end flaps 1041*a*, 1043*a*, 1045*a*, 1047*a* close a first end 1055 of the carton, and the end flaps 1041*b*, 1043*b*, 1045*b*, 1047*b* close a second end 1057 of the carton. In accordance with an alternative embodiment of the present disclosure, different flap arrangements can be used for closing the ends 1055, 1057 of the carton 1005.

In the illustrated embodiment, the features that form the dispenser 1007 in the carton 1005 include the dispenser panel 1101 in the top panel 1031. The dispenser panel 1101 is formed by a tear line 1105 comprising lateral portions 1107 that are generally collinear with the lateral fold lines 1033, 1037. The tear line 1105 can include four oblique portions 1109 extending from respective ends of the lateral portions 1107 to respective longitudinal portions 1113, which can be generally collinear with the longitudinal fold lines 1051*a*, 1051*b*. The oblique portions of the tear line 1105 can be configured so that the slits forming the tear line do not interrupt or cut across the oblique fold lines 1093. Accordingly, the oblique fold lines 1093 can help direct the forces on the top panel 1031 at the handle 1011 to the corners of the carton 1005 when the weight of the carton 1005 is supported at the handle 1011.

As shown in FIG. 25, the dispenser 1007 further includes respective access features 1178 in the top panel 1031. Each of the access features can include access flaps 1176 at least partially defined by curved tear lines 1173. Alternatively, the tear lines 1173 could be cuts. The access flaps 1176 can be further defined by the respective longitudinal fold lines 1151*a*, 1151*b*. The dispenser panel 1101, the tear line 1105, and/or the access features 1178 can be omitted or otherwise shaped, arranged, and/or configured without departing from the disclosure.

The features that comprise the handle 1011 include a handle flap 1075 in the top panel 1031, within the dispenser panel 1101. The handle flap 1075 can be foldably connected to the top panel 1031 along a lateral fold line 1076 and can be separable from the top panel 1031 along a curved cut or tear line. In another embodiment, the lateral fold line 1076 could be replaced by a longitudinal or oblique fold line for a different orientation of the handle flap 1075. The handle flap 1075 could be otherwise shaped, arranged, and/or configured without departing from the disclosure, and the blank 1003 could have other features for forming the handle 1011 without departing from the disclosure. For example, the handle flap could be omitted, and the handle could include one or more handle apertures in the top panel. In an alternative example, the handle 1011 can include a plurality of handle flaps in the top panel.

Figure 26:
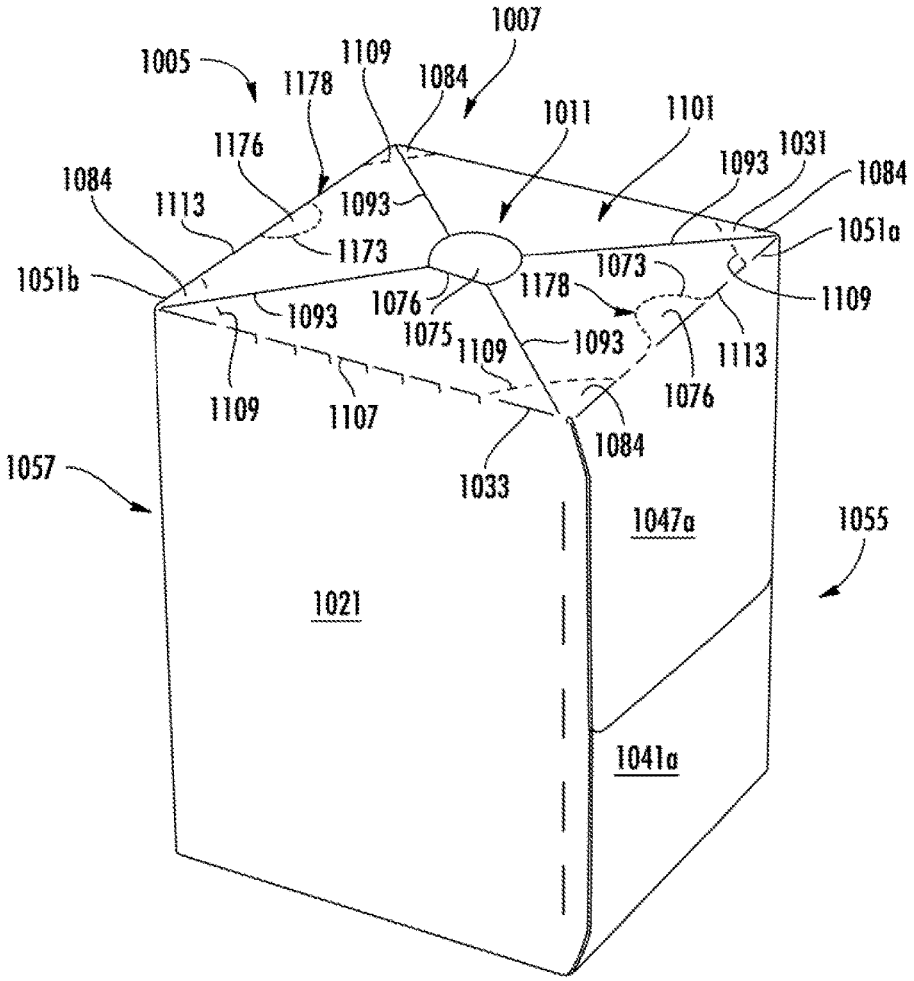
FIG. 26 is a perspective view of the carton assembled from the blank of FIG. 25.

The erected carton 1005 is shown in FIG. 26. In one embodiment, the handle flap 1075 can be folded inwardly for carrying the carton. The dispenser 1007 can be activated by initiating tearing at the access features 1178. A user can push the access flaps 1176 into the interior of the carton, folding the access flaps inwardly along the respective longitudinal fold lines 1051*a*, 1051*b*, and separating the access flaps 1176 from the dispenser panel 1101 along the curved tear lines 1173. The dispenser panel 1101 then can be grasped at one or both of the openings formed at the access features 1178 and be pulled upwardly to tear the tear line 1105 along the longitudinal portions 1113, then the oblique portions 1109, and then the lateral portions 1107. The tearing can be initiated at one access feature 1178 or at both access features 1178 simultaneously. For example, in one embodiment, the tearing can be initiated at the access feature 1178 adjacent the second end 1157 of the carton 1005, and the dispenser panel 1101 can be pivoted upwardly along the longitudinal portions 1113 that are generally collinear with the first longitudinal fold line 1051*a* to form a dispenser opening 1127. The dispenser panel 1101 can be fully removed from the carton by tearing along the remaining longitudinal portions 1113 of the tear line 1105. The carton 1005 can be opened by alternative steps without departing from the disclosure.

Figure 27:
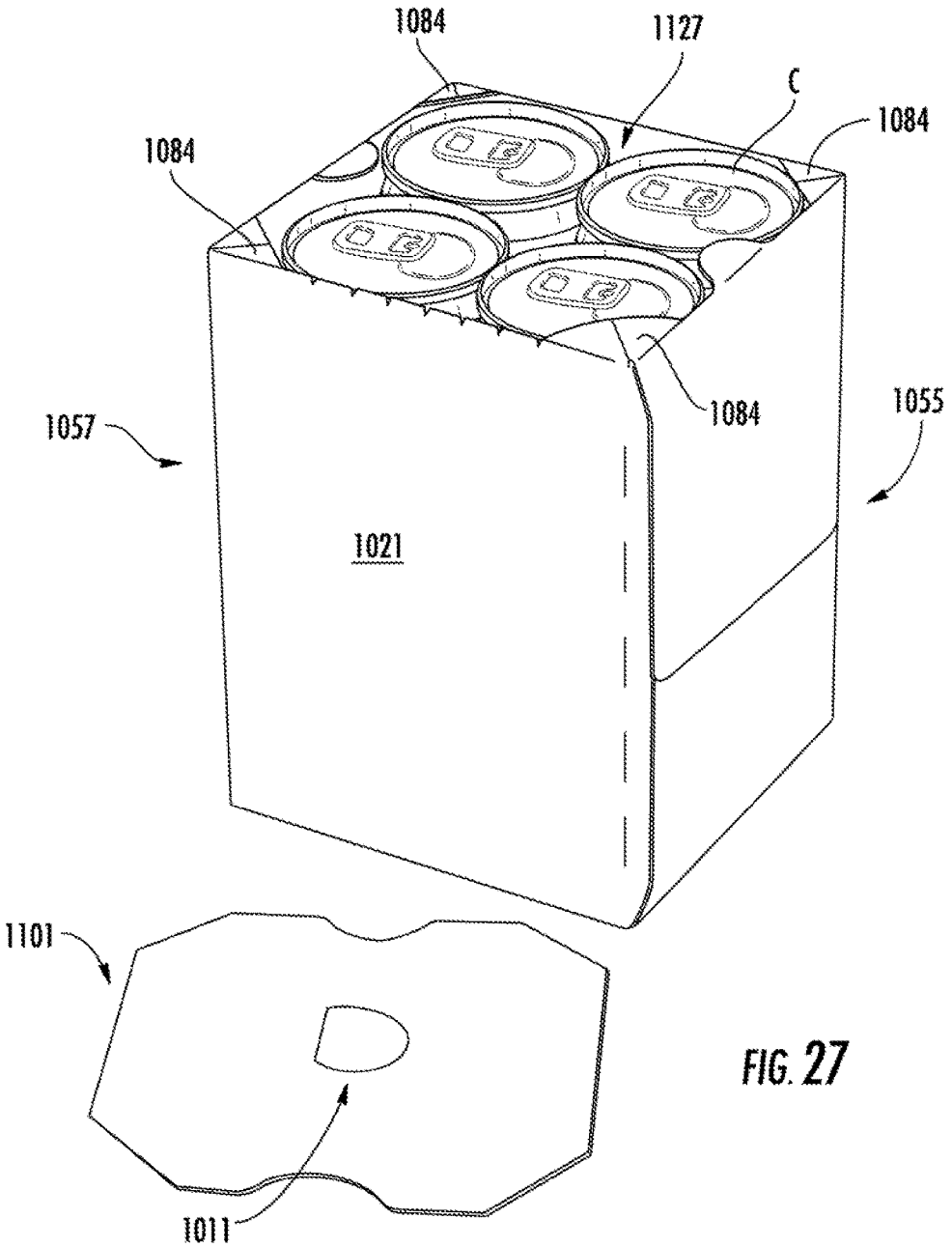
FIG. 27 is a perspective view of the carton of FIG. 26 with the dispenser panel removed.

As shown in FIG. 27, the dispenser panel 1101 can be fully removed with the handle 1011. Corner portions 1084 can be formed at the four corners of the top panel 1031 and can remain connected to the remainder of the carton 1005 when the dispenser panel 1101 is removed. As shown in FIGS. 26 and 27, the corner portions 1084 are defined by the oblique portions 1109 of the tear line 1105. Accordingly, the corner portions 1084 can partially retain containers C in the carton 1005 after removal of dispenser panel 1101 to help inhibit undesired removal of the containers C, but allow a user to remove the containers when desired. The top panel 1031, the dispenser 1007, and the corner portions 1084 can be omitted or otherwise shaped, arranged, and/or configured without departing from the disclosure.

Figure 28:
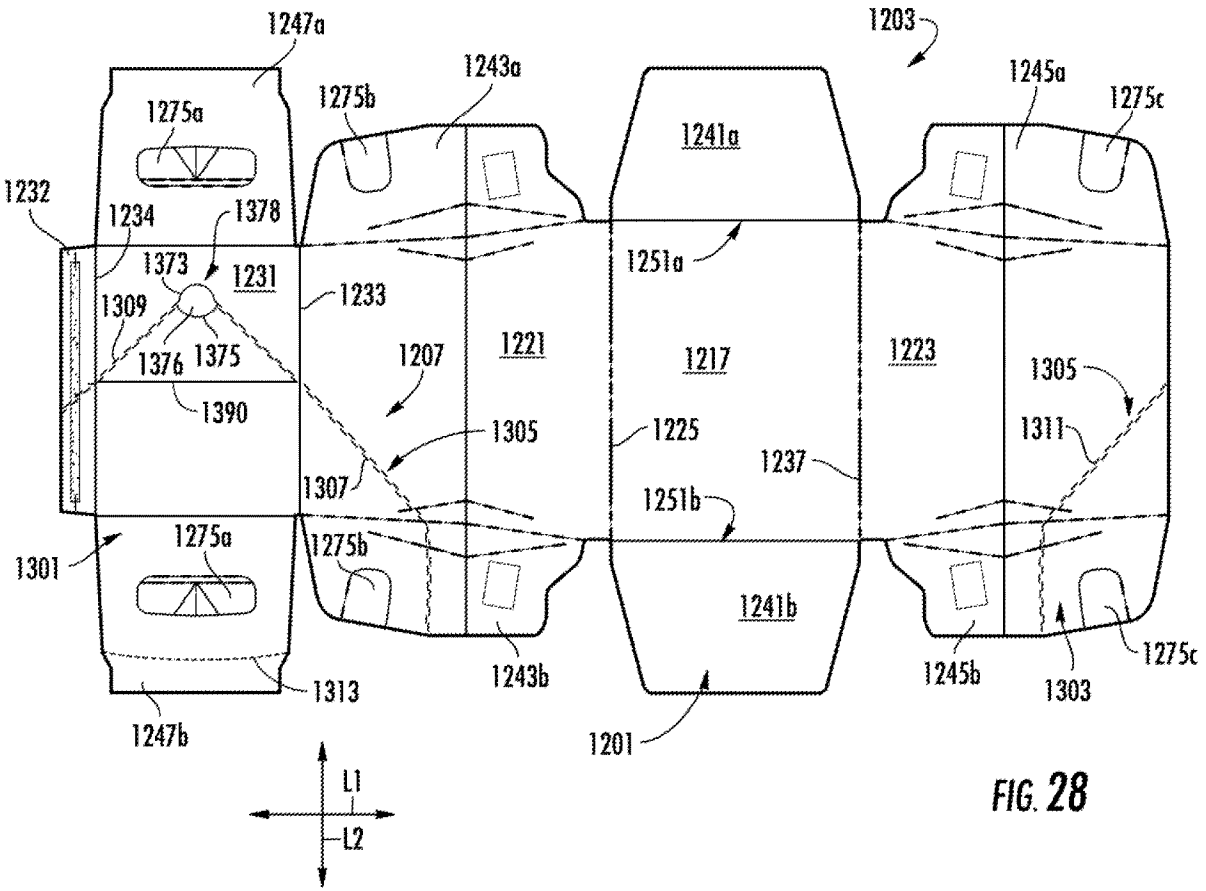
FIG. 28 is a plan view of a blank used to form a carton according to a seventh embodiment of the disclosure.

FIG. 28 illustrates an exterior side 1201 of a blank 1203 for forming a carton 1205 according to a seventh embodiment of the disclosure. The seventh embodiment is generally similar to the third embodiment, except for variations noted and variations that will be apparent to one of ordinary skill in the art. Accordingly, similar or identical features of the embodiments have been given like or similar reference numbers. The blank 1203 has a longitudinal axis L1 and a lateral axis L2. The carton 1205 is illustrated in its erected state in FIGS. 29-31. The carton 1205 includes a dispenser 1207. A handle 1211 extends in the dispenser 1207 in one end of the carton 1205, and a handle 1212 extends in the opposing end of the carton 1205, outside the dispenser 1207.

In the illustrated embodiment, the carton 1205 is sized to house twelve containers C (FIG. 31) in a single layer in a 3×4 arrangement, but it is understood that the carton may be sized and shaped to hold containers of a different or same quantity in more than one layer and/or in different row/column arrangements (e.g., 1×6, 3×6, 4×4, 2×6, 2×6×2, 3×4×2, 2×9, etc.). In the illustrated embodiment, the containers C can be 12-oz bottles (e.g., glass bottles); however, the containers C alternatively can be any style of container.

As shown in FIG. 28, the blank 1203 includes a bottom panel 1217, a first side panel 1221 foldably connected to the bottom panel 1217 along a lateral fold line 1225, a top panel

1231 foldably connected to the first side panel 1221 along a lateral fold line 1233, and a second side panel 1223 foldably connected to the bottom panel 1217 along a lateral fold line 1237. An attachment flap 1232 can be foldably connected to the top panel 1231 along a lateral fold line 1234. The attachment flap 1232 can be adhered to the interior surface of the second side panel 1223 when erecting the carton 1205. Alternatively, the attachment flap can be foldably connected to the second side panel 1223 for being adhered to the bottom panel 1217 when the carton is erected.

End flaps 1241*a*, 1243*a*, 1245*a*, 1247*a* can extend along a first marginal area of the blank 1203, and are foldably connected to the respective panels at a first longitudinal fold line 1251*a* that extends along the length of the blank. End flaps 1241*b*, 1243*b*, 1245*b*, 1247*b* can extend along a second marginal area of the blank 1203, and are foldably connected to the respective panels at a second longitudinal fold line 1251*b* that also extends along the length of the blank. When the carton 1205 is erected, the end flaps 1241*a*, 1243*a*, 1245*a*, 1247*a* close a first end 1255 of the carton, and the end flaps 1241*b*, 1243*b*, 1245*b*, 1247*b* close a second end 1257 of the carton. In accordance with an alternative embodiment of the present disclosure, different flap arrangements can be used for closing the ends 1255, 1257 of the carton 1205.

In the illustrated embodiment, the blank 1203 can include diamond corner panels and the top panel 1231 is smaller in the longitudinal L1 direction and the lateral L2 direction. Accordingly, the upper portions of the side panels 1221, 1223 and the ends 1255, 1257 can taper inwardly to help secure the tapered upper portions of the containers C within the carton 1205. Alternatively, less than all of the sides and ends of the carton can be tapered.

In the illustrated embodiment, the features that form the dispenser 1207 in the carton 1205 include a first dispenser panel 1301 in the top panel 1231, the first side panel 1221, the attachment flap 1232, the top end flap 1247*b*, and the side end flap 1243*b*. The dispenser 1207 further includes a second dispenser panel 1303 in the second side panel 1223 and the side end flap 1245*b*. The dispenser panels 1301, 1303 are formed by a tear line 1305 comprising a first portion 1307 extending in the top panel 1231, the first side panel 1221, and the side end flap 1243*b*; a second portion 1309 extending in the top panel 1231 and the attachment flap 1232; and a third portion 1311 extending in the second side panel 1223 and the side end flap 1245*b*. A fourth portion 1313 of the tear line 1305 extends in the second top end flap 1247*b*. In the erected carton, the third portion 1311 partially overlaps the second portion 1309 where the second side panel 1223 overlaps the attachment flap 1232. Additionally, the fourth portion 1313 overlaps the first and third portions 1307, 1311 where the top end flap 1247*b* overlaps the side end flaps 1243*b*, 1245*b* at the closed end 1257 of the carton. In the erected carton 1205, the dispenser panels 1301, 1303 form a dispenser panel 1325 (FIGS. 29-31).

As shown in FIG. 28, the dispenser 1207 further includes an access feature 1378 in the top panel 1231. The access feature can include an access flap 1376 at least partially defined by a curved cut or tear line 1373. The access flap 1376 can be further defined by a curved fold line 1375. The dispenser panel 1301 can also include a longitudinal fold line 1390 to help in lifting the dispenser panel 1325 while tearing along the tear line 1305. The dispenser panels 1301, 1303, the tear line 1305, and/or the access feature 1378 can be omitted or otherwise shaped, arranged, and/or configured without departing from the disclosure.

The features that comprise the handle 1211 in the closed end 1257 of the carton 1205 include a handle flap 1275*a* in the top end flap 1247*b*, which overlaps the handle flaps 1275*b* and 1275*c* in the respective side end flaps 1243*b*, 1245*b*. The handle flaps 1275*a*, 1275*b*, 1275*c* extend within portions of the dispenser panel 1301. The handle flap 1275*a* can be foldably connected to the respective end flaps 1247*b*, 1243*b*, 1245*b* and can be separable from the same along respective curved cut or tear lines. The handle flaps 1275*a*, 1275*b*, 1275*c* could be otherwise shaped, arranged, and/or configured without departing from the disclosure, and the blank 1203 could have other features for forming the handle 1211 without departing from the disclosure. For example, one or more of the handle flaps could be omitted, and the handle could include handle apertures and/or one or more handle flaps in combination with one or more handle apertures. The handle 1212 in the closed end 1255 can be substantially similar or identical to the handle 1211 in the illustrated embodiment. Alternatively, the handle 1212 could be omitted or otherwise configured.

Figure 29:
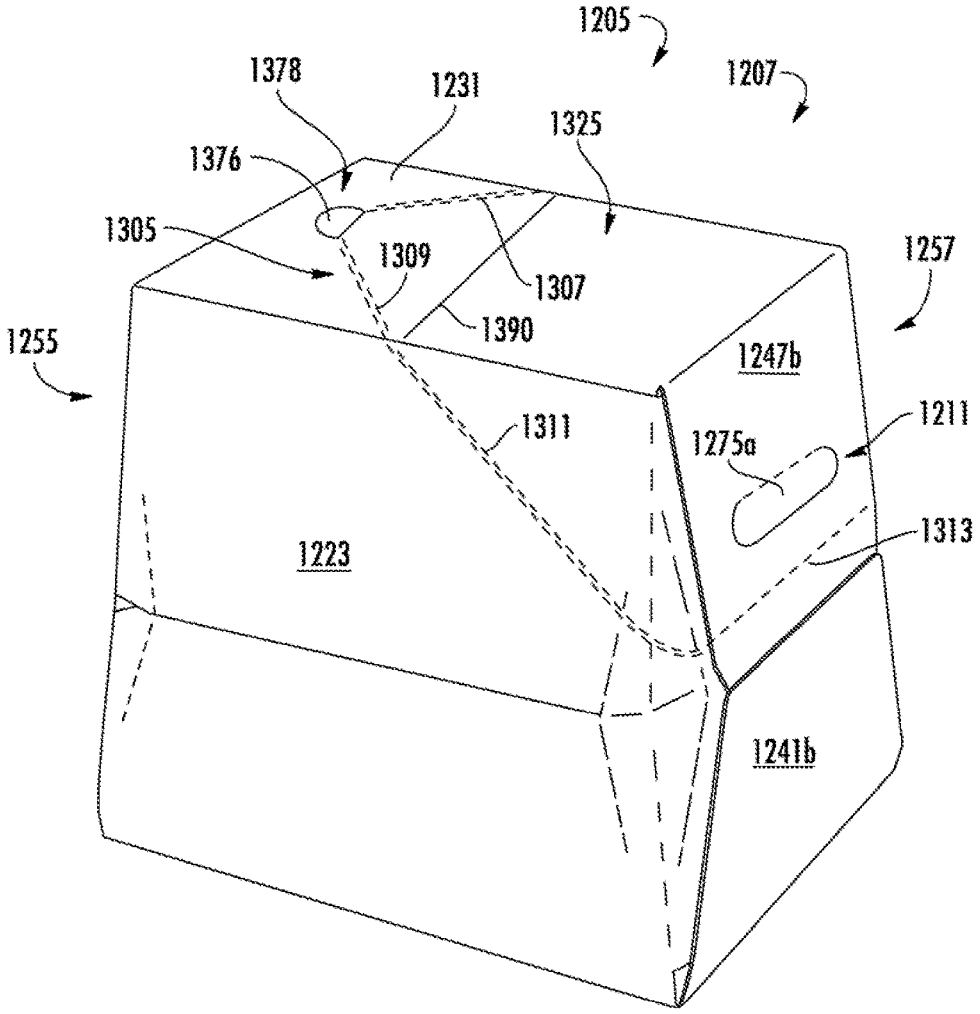
FIGS. 29 and 30 are perspective views of the carton assembled from the blank of FIG. 28.
Figure 30:
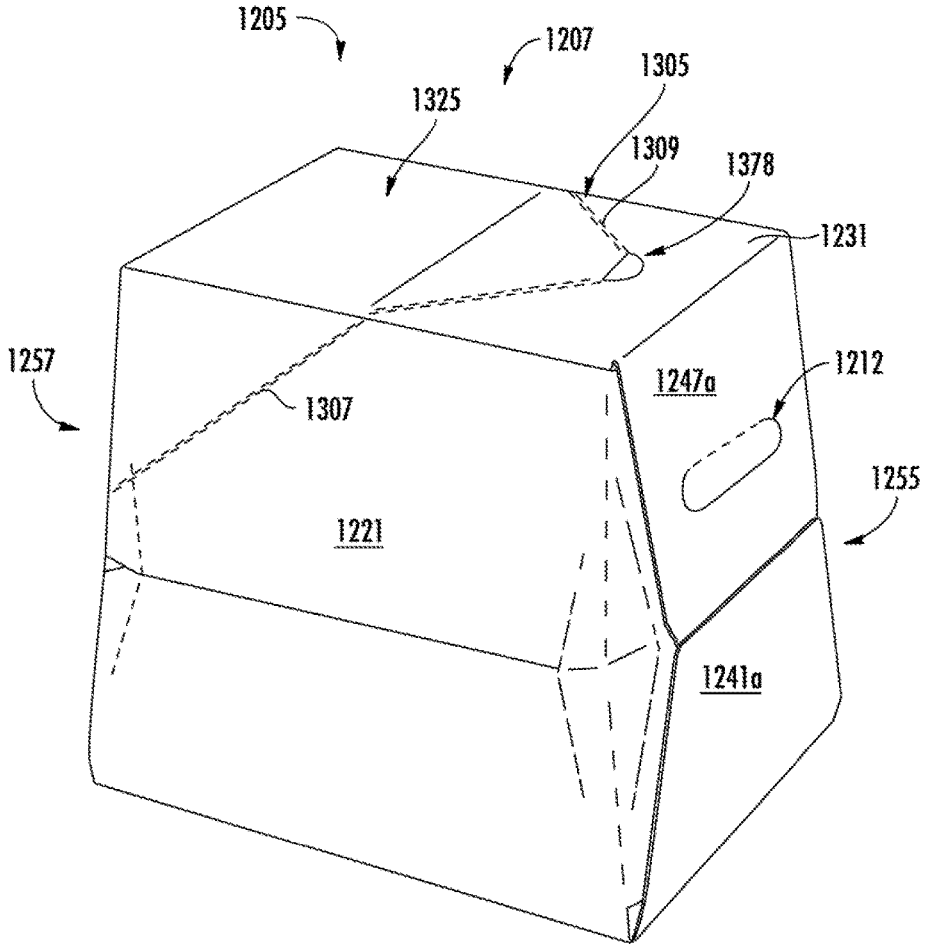
Figure 31:
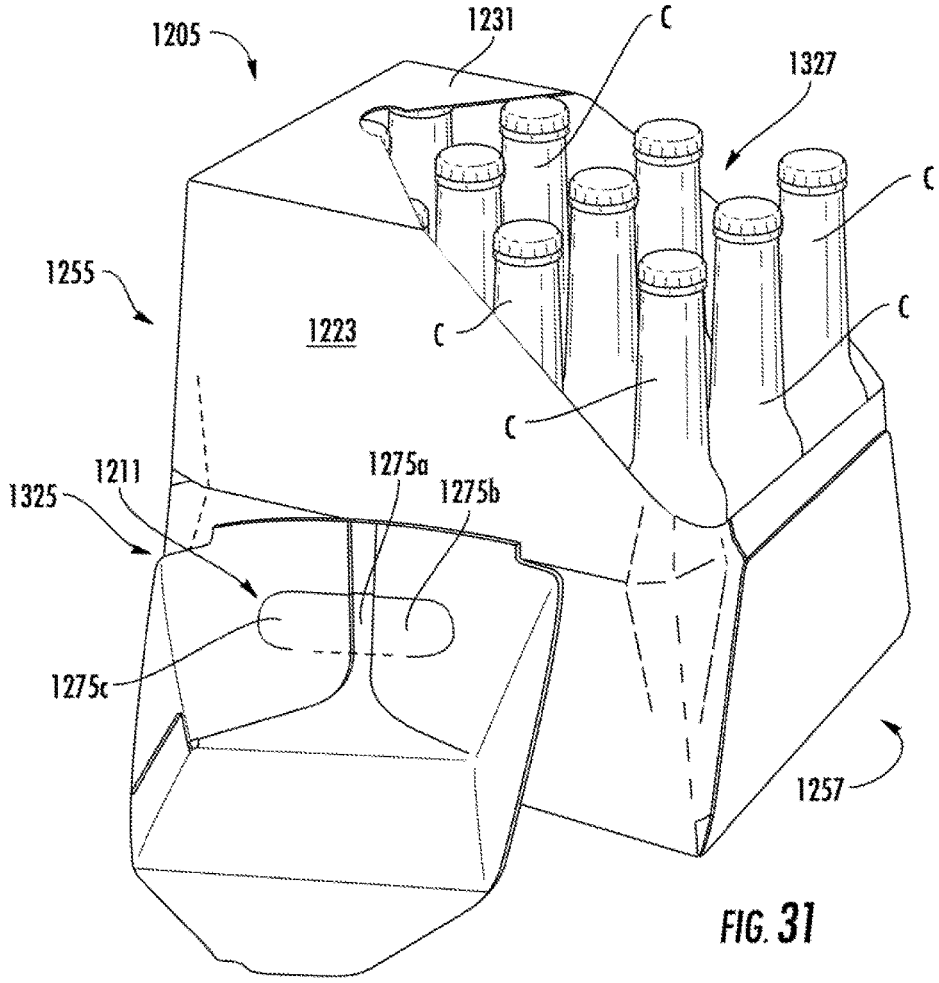
FIG. 31 is a perspective view of the carton of FIGS. 29 and 30 with the dispenser panel removed.

The erected carton 1205 is shown in FIGS. 29 and 30. The dispenser 1207 can be activated by initiating tearing at the access feature 1378. A user can push the access flap 1376 into the interior of the carton, folding the access flap inwardly along the curved fold line 1375, and separating the access flap from the top panel 1231 along the curved tear line 1373. The dispenser panel 1325 can then be grasped at the opening formed at the access feature 1378 and can be pulled upwardly to tear the dispenser panel away from the top panel 1231, the side panels 1221, 1223, and the closed end 1257 to form a dispenser opening 1327 (FIG. 31). As shown in FIG. 31, the dispenser panel 1325 is fully removed with the handle 1211. In the illustrated embodiment, it is easier to tear the tear line 1305 from the access feature 1378 in the top panel 1231 than from the closed end 1257 of the carton 1205 (e.g., due to the multiple overlapping layers that the tear line extends through in the closed end). Accordingly, the configuration of the tear line 1305 can help avoid unwanted tearing in the carton 1205 when carrying the carton from the handle 1211. The carton 1205 can be opened by alternative steps without departing from the disclosure.

Any of the features of the various embodiments of the disclosure can be combined with, replaced by, or otherwise configured with other features of other embodiments of the disclosure without departing from the scope of this disclosure. Further, it is noted that the dispenser features and/or handle features of the various embodiments can be incorporated into a carton having any carton style or panel configuration. The carton styles and panel configurations described above are included by way of example.

Cartons or blanks according to the principles of the present disclosure may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. For example, the caliper can be at least about 24, but the caliper may be more or less than this amount without departing from the disclosure. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or panels adhered together by glue. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A carton for holding a plurality of containers, the carton comprising:

a plurality of panels extending at least partially around an interior of the carton;

a dispenser comprising a dispenser panel, the dispenser panel being at least partially defined by a tear line extending in at least one panel of the plurality of panels, the dispenser panel being at least partially removable from the carton to create a dispenser opening allowing access to the interior; and a handle for grasping and carrying the carton, the handle comprising a handle feature, wherein the handle feature extends in at least the dispenser panel and is spaced apart from the tear line, at least a portion of the handle being removable from the carton with the dispenser panel.

2. The carton of claim 1, wherein the plurality of panels comprises a first panel foldably connected to a second panel, the dispenser panel comprises at least a portion of the first panel, and the handle feature is disposed in at least the first panel.

3. The carton of claim 2, wherein the handle feature comprises a handle flap foldably connected to the first panel.

4. The carton of claim 3, wherein the first panel is a top panel and the second panel is a side panel.

5. The carton of claim 2, wherein the first panel is foldably connected to the second panel along a first fold line, and the tear line comprises a first portion that is generally collinear with at least a portion of the first fold line and a second portion extending from an end of the first portion, the second portion being oblique with respect to the first portion.

6. The carton of claim 5, wherein at least the second portion of the tear line comprises a series of cuts and a gap between two cuts of the series of cuts, and the first panel comprises a score extending from a corner of the first panel to a position generally adjacent the handle feature of the handle, the score extending in the gap of the second portion of the tear line.

7. The carton of claim 6, further comprising end flaps respectively foldably connected to respective panels of the plurality of panels, the end flaps being at least partially overlapped with respect to one another and thereby at least partially form a closed end of the carton, the end flaps comprising at least a first end flap foldably connected to the first panel along a second fold line, wherein the tear line comprises a third portion that is generally collinear with at least a portion of the second fold line, and the second portion of the tear line extends between respective ends of the first portion and the third portion of the tear line.

8. The carton of claim 7, further comprising an access feature at least partially defined by an access tear line extending in the first panel from an end of the third portion of the tear line.

9. The carton of claim 2, wherein the dispenser panel further comprises at least a portion of the second panel, the tear line extending in at least the first panel and the second panel.

10. The carton of claim 9, further comprising an access feature disposed in at least the second panel, the tear line extending adjacent at least a portion of the access feature.

11. The carton of claim 10, wherein the access feature comprises an access flap at least partially defined by a cut line extending in the second panel, the cut line comprising at least one end adjacent the tear line.

12. The carton of claim 11, wherein the cut line is generally U-shaped, and the access flap is foldably connected to the dispenser panel along an access fold line extending between respective portions of the cut line.

13. The carton of claim 11, wherein access flap is a first access flap, the cut line is a first cut line, and the access feature comprises a second access flap at least partially defined by a cut line extending in the second panel.

14. The carton of claim 13, wherein the access feature is foldably connected to the dispenser panel along a curved fold line extending between portions of the tear line in the second panel.

15. The carton of claim 11, wherein the plurality of panels further comprises a third panel foldably connected to the first panel, the dispenser panel further comprises at least a portion of the third panel, the tear line further extending in at least the third panel.

16. The carton of claim 15, wherein the access feature is a first access feature, and the carton further comprises a second access feature disposed in at least the third panel, the tear line extending adjacent at least a portion of the third access feature.

17. The carton of claim 16, wherein the first panel is a top panel, the second panel is a first side panel, and the third panel is a second side panel.

18. The carton of claim 2, wherein the handle is a primary handle, and the carton further comprises a secondary handle that is spaced apart from the handle, the secondary handle being for grasping and carrying the carton after removing the dispenser panel.

19. The carton of claim 18, wherein the secondary handle comprises an end flap foldably connected to the first panel and a gusset foldably connected to the second panel and the end panel.

20. The carton of claim 1, further comprising an access feature disposed adjacent the dispenser panel, at least a portion of the tear line extending from the access feature, the plurality of panels comprises a first panel foldably connected to a second panel, the access feature is disposed in at least the first panel, and at least a first portion of the tear line extends in the first panel from the access feature and into the second panel, the carton further comprising end flaps respectively foldably connected to respective panels of the plurality of panels, the end flaps being at least partially overlapped with respect to one another and thereby at least partially form a closed end of the carton, the end flaps comprising at least a first end flap foldably connected to the first panel and a second end flap foldably connected to the second panel, wherein the first portion of the tear line extending in the first panel and the second panel further extends at least partially across the second end flap.

21. The carton of claim 20, wherein the tear line comprises a second portion extending in the first end flap, the second portion of the tear line at least partially overlapping the first portion of the tear line.

22. The carton of claim 20, wherein the dispenser panel further comprises at least a portion of the first end flap, and the handle feature comprises a handle flap foldably connected to the first end flap.

23. The carton of claim 22, wherein the dispenser further comprises at least a portion of the second end flap, the handle flap is a first handle flap, and the handle feature further comprises a second handle flap foldably connected to the second end flap, the first handle flap at least partially overlapping the second handle flap.

24. The carton of claim 22, wherein the end flaps are first end flaps and the closed end is a first closed end, and the carton further comprises second end flaps respectively foldably connected to respective panels of the plurality of panels, the second end flaps being at least partially overlapped with respect to one another and thereby at least partially form a second closed end of the carton, the dispenser panel being spaced apart from the second closed end of the carton.

25. The carton of claim 24, wherein the handle comprises a first handle, and the carton comprises a second handle at least partially disposed in the second end of the carton.

26. The carton of claim 1, wherein the handle is a first handle, the carton comprising a second handle that is spaced apart from the dispenser panel.

27. A carton for holding a plurality of containers, the carton comprising:

a plurality of panels extending at least partially around an interior of the carton, wherein the plurality of panels comprises a first panel foldably connected to a second panel along a first fold line;

a dispenser comprising a dispenser panel, the dispenser panel being at least partially defined by a tear line extending in at least one panel of the plurality of panels, the dispenser panel being at least partially removable from the carton to create a dispenser opening allowing access to the interior, wherein the dispenser panel comprises at least a portion of the first panel;

a handle for grasping and carrying the carton, the handle comprising a handle feature extending in at least the dispenser panel, at least a portion of the handle being removable from the carton with the dispenser panel, wherein the handle feature is disposed in at least the first panel;

end flaps respectively foldably connected to respective panels of the plurality of panels, the end flaps being at least partially overlapped with respect to one another and thereby at least partially form a closed end of the carton, the end flaps comprising at least a first end flap foldably connected to the first panel along a second fold line, wherein a portion of the tear line is generally collinear with at least a portion of the second fold line; and an access feature at least partially defined by an access tear line extending in the first panel from an end of the portion of the tear line, wherein the access feature comprises an access flap foldably connected to the first end flap along the second fold line.

28. A blank for forming a carton for holding a plurality of containers, the blank comprising:

a plurality of panels for forming an interior of the carton formed from the blank;

dispenser features for forming a dispenser in the carton formed from the blank, the dispenser features comprising a dispenser panel at least partially defined by a tear line extending in at least one panel of the plurality of panels, the dispenser panel being at least partially removable from the carton formed from the blank to allow access to the interior; and handle features for forming a handle in the carton formed from the blank, the handle features extending in at least the dispenser panel and being spaced apart from the tear line, at least a portion of the handle features being removable from the carton formed from the blank with the dispenser panel.

29. The blank of claim 28, wherein the plurality of panels comprises a first panel foldably connected to a second panel, the dispenser panel comprises at least a portion of the first panel, and the handle feature is disposed in at least the first panel.

30. The blank of claim 29, wherein the handle feature comprises a handle flap foldably connected to the first panel.

31. The blank of claim 30, wherein the first panel is a top panel and the second panel is a side panel.

32. The blank of claim 29, wherein the first panel is foldably connected to the second panel along a first fold line, and the tear line comprises a first portion that is generally collinear with at least a portion of the first fold line and a second portion extending from an end of the first portion, the second portion being oblique with respect to the first portion.

33. The blank of claim 32, wherein at least the second portion of the tear line comprises a series of cuts and a gap between two cuts of the series of cuts, and the first panel comprises a score extending from a corner of the first panel to a position generally adjacent the handle feature of the handle, the score extending in the gap of the second portion of the tear line.

34. The blank of claim 32, further comprising end flaps respectively foldably connected to respective panels of the plurality of panels, the end flaps comprising at least a first end flap foldably connected to the first panel along a second fold line, wherein the tear line comprises a third portion that is generally collinear with at least a portion of the second fold line, and the second portion of the tear line extends between respective ends of the first portion and the third portion of the tear line.

35. The blank of claim 34, further comprising an access feature at least partially defined by an access tear line extending in the first panel from an end of the third portion of the tear line.

36. The blank of claim 29, wherein the dispenser panel further comprises at least a portion of the second panel, the tear line extending in at least the first panel and the second panel.

37. The blank of claim 36, further comprising an access feature disposed in at least the second panel, the tear line extending adjacent at least a portion of the access feature, wherein the access feature comprises an access flap at least partially defined by a cut line extending in the second panel, the cut line comprising at least one end adjacent the tear line.

38. The blank of claim 37, wherein the cut line is generally U-shaped, and the access flap is foldably connected to the dispenser panel along an access fold line extending between respective portions of the cut line.

39. The blank of claim 37, wherein access flap is a first access flap, the cut line is a first cut line, and the access feature comprises a second access flap at least partially defined by a cut line extending in the second panel.

40. The blank of claim 39, wherein the access feature is foldably connected to the dispenser panel along a curved fold line extending between portions of the tear line in the second panel.

41. The blank of claim 37, wherein the plurality of panels further comprises a third panel foldably connected to the first panel, the dispenser panel further comprises at least a portion of the third panel, the tear line further extends in at least the third panel, the access feature is a first access feature, and the carton further comprises a second access feature disposed in at least the third panel, the tear line extending adjacent at least a portion of the third access feature.

42. The blank of claim 41, wherein the first panel is a top panel, the second panel is a first side panel, and the third panel is a second side panel.

43. The blank of claim 29, wherein the handle is a primary handle, and the blank further comprises a secondary handle that is spaced apart from the handle, the secondary handle being for grasping and carrying the carton formed from the blank after removing the dispenser panel.

44. The blank of claim 43, wherein the secondary handle comprises an end flap foldably connected to the first panel and a gusset foldably connected to the second panel and the end panel.

45. The blank of claim 28, further comprising an access feature disposed adjacent the dispenser panel, at least a portion of the tear line extending from the access feature, the plurality of panels comprises a first panel foldably connected to a second panel, the access feature is disposed in at least the first panel, and at least a first portion of the tear line extends in the first panel from the access feature and into the second panel, the blank further comprising end flaps respectively foldably connected to respective panels of the plurality of panels, the end flaps comprising at least a first end flap foldably connected to the first panel and a second end flap foldably connected to the second panel, wherein the first portion of the tear line extending in the first panel and the second panel further extends at least partially across the second end flap.

46. The blank of claim 45, wherein the dispenser panel further comprises at least a portion of the first end flap, and the handle feature comprises a handle flap foldably connected to the first end flap.

47. The blank of claim 46, wherein the dispenser features further comprise at least a portion of the second end flap, the handle flap is a first handle flap, and the handle feature further comprises a second handle flap foldably connected to the second end flap, the first handle flap for at least partially overlapping the second handle flap when the carton is formed from the blank.

48. The blank of claim 46, wherein the end flaps are first end flaps, and the blank further comprises second end flaps respectively foldably connected to respective panels of the plurality of panels, the second end flaps being spaced apart from the first end flaps, and the dispenser panel being spaced apart from the second end flaps.

49. The blank of claim 48, wherein the handle features comprise first handle features, and the blank comprises second handle features at least partially disposed in the second end flaps.

50. The blank of claim 28, wherein the handle features comprise first handle features for forming a first handle in the carton formed from the blank, and the blank comprises second handle features for forming a second handle in the carton formed from the blank, the second handle features being spaced apart from the dispenser panel.

51. A blank for forming a carton for holding a plurality of containers, the blank comprising:

a plurality of panels for forming an interior of the carton formed from the blank, wherein the plurality of panels comprises a first panel foldably connected to a second panel;

dispenser features for forming a dispenser in the carton formed from the blank, the dispenser features comprising a dispenser panel at least partially defined by a tear line extending in at least one panel of the plurality of panels, the dispenser panel being at least partially removable from the carton formed from the blank to allow access to the interior, wherein the dispenser panel comprises at least a portion of the first panel;

handle features for forming a handle in the carton formed from the blank, the handle features extending in at least the dispenser panel, at least a portion of the handle features being removable from the carton formed from the blank with the dispenser panel, wherein the handle feature is disposed in at least the first panel;

end flaps respectively foldably connected to respective panels of the plurality of panels, the end flaps comprising at least a first end flap foldably connected to the first panel along a second fold line, wherein a portion of the tear line is generally collinear with at least a portion of the second fold line; and an access feature at least partially defined by an access tear line extending in the first panel from an end of the portion of the tear line, wherein the access feature comprises an access flap foldably connected to the first end flap along the second fold line.

52. A method of opening a carton, the method comprising:

obtaining a carton comprising a plurality of panels extending at least partially around an interior of the carton, a dispenser comprising a dispenser panel, and a handle for grasping and carrying the carton, the dispenser panel being at least partially defined by a tear line extending in at least one panel of the plurality of panels, and the handle comprising a handle feature, wherein the handle feature extends in at least the dispenser panel and is spaced apart from the tear line;

at least partially removing the dispenser panel to form a dispenser opening in the carton, the dispenser opening providing access to the interior of the carton, wherein the at least partially removing the dispenser panel comprises at least partially removing the handle feature in the dispenser panel.

53. The method of claim 52, wherein:

the plurality of panels comprises a first panel foldably connected to a second panel, the dispenser panel comprises at least a portion of the first panel, and the handle feature is disposed in at least the first panel;

the dispenser panel further comprises at least a portion of the second panel, the tear line extending in at least the first panel and the second panel;

the carton comprises an access feature disposed in at least the second panel, the tear line extending adjacent at least a portion of the access feature; and the at least partially removing the dispenser panel comprises actuating the access feature in the second panel, gripping the dispenser panel adjacent the access feature, and tearing along the tear line.

54. The method of claim 53, wherein:

the plurality of panels further comprises a third panel foldably connected to the first panel, and the dispenser panel further comprises at least a portion of the third panel, the tear line further extending in at least the third panel;

the access feature is a first access feature, and the carton further comprises a second access feature disposed in at least the third panel, the tear line extending adjacent at least a portion of the third access feature; and the at least partially removing the dispenser panel comprises actuating the first access feature and the second access feature, gripping the dispenser panel adjacent the first access feature and the second access feature, and tearing along the tear line from both of the first access feature and the second access feature.

55. The method of claim 52, wherein:

the handle is a first handle, and the carton comprises a second handle that is spaced apart from the dispenser panel; and the method further comprises grasping and carrying the carton at the second handle after the at least partially removing the dispenser panel.

56. A method of opening a carton, the method comprising:

obtaining a carton comprising:

a plurality of panels extending at least partially around an interior of the carton, wherein the plurality of panels comprises a first panel foldably connected to a second panel along a first fold line;

a dispenser comprising a dispenser panel, the dispenser panel being at least partially defined by a tear line extending in at least one panel of the plurality of panels, wherein the dispenser panel comprises at least a portion of the first panel;

a handle for grasping and carrying the carton, the handle comprising a handle feature extending in at least the dispenser panel, wherein the handle feature is disposed in at least the first panel;

end flaps respectively foldably connected to respective panels of the plurality of panels, the end flaps being at least partially overlapped with respect to one another and thereby at least partially form a closed end of the carton, the end flaps comprising at least a first end flap foldably connected to the first panel along a second fold line, wherein a portion of the tear line is generally collinear with at least a portion of the second fold line; and an access feature at least partially defined by an access tear line extending in the first panel from an end of the portion of the tear line, wherein the access feature comprises an access flap foldably connected to the first end flap along the second fold line; and at least partially removing the dispenser panel to form a dispenser opening in the carton, the dispenser opening providing access to the interior of the carton, wherein the at least partially removing the dispenser panel comprises at least partially removing the handle feature in the dispenser panel.

* * * * *